US011708234B2

(12) United States Patent
Wakabayashi et al.

(10) Patent No.: US 11,708,234 B2
(45) Date of Patent: Jul. 25, 2023

(54) SHEET CONVEYING DEVICE AND IMAGE FORMING APPARATUS INCORPORATING THE SHEET CONVEYING DEVICE

(71) Applicants: Yu Wakabayashi, Kanagawa (JP); Kazuya Yamamoto, Kanagawa (JP); Yasuhide Fukushima, Tokyo (JP); Yuuki Shiga, Kanagawa (JP); Ryohhei Ohya, Kanagawa (JP)

(72) Inventors: Yu Wakabayashi, Kanagawa (JP); Kazuya Yamamoto, Kanagawa (JP); Yasuhide Fukushima, Tokyo (JP); Yuuki Shiga, Kanagawa (JP); Ryohhei Ohya, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 188 days.

(21) Appl. No.: 17/145,956

(22) Filed: Jan. 11, 2021

(65) Prior Publication Data

US 2021/0221636 A1 Jul. 22, 2021

(30) Foreign Application Priority Data

Jan. 17, 2020 (JP) ..... 2020-006247

(51) Int. Cl.
*B65H 29/12* (2006.01)

(52) U.S. Cl.
CPC ..... *B65H 29/12* (2013.01); *B65H 2511/13* (2013.01); *B65H 2511/224* (2013.01); *B65H 2511/528* (2013.01); *B65H 2515/34* (2013.01)

(58) Field of Classification Search
CPC ..... B65H 2601/11; B65H 2511/528; B65H 29/12
See application file for complete search history.

(56) References Cited

U.S. PATENT DOCUMENTS 5,499,807 A * 3/1996 Nakamura ..... B65H 3/5238 492/11
5,580,046 A * 12/1996 Beaufort ..... B65H 7/00 271/4.02

(Continued)

FOREIGN PATENT DOCUMENTS

JP 2002-307737 10/2002
JP 2002296948 A * 10/2002

(Continued)

*Primary Examiner* — Howard J Sanders
(74) *Attorney, Agent, or Firm* — Harness, Dickey & Pierce, P.L.C.

(57) ABSTRACT

A sheet conveying device includes a pair of rollers including a first roller and a second roller to hold a sheet conveyed between the first and second rollers; a biasing member to bias the first roller toward the second roller; a biasing force changer to change a biasing force of the biasing member; control circuitry to, when a predetermined changing condition is met, cause the changer to change the biasing force and cause the rollers to convey the sheet; an operation detector to detect a changing operation of the changer; and a notification device to notify an abnormality of the changing operation when the operation detector detects the abnormality. When the operation detector detects the abnormality, the control circuitry performs sheet conveyance control to cause the rollers to convey the sheet without causing the changer to change the biasing force, regardless of whether the predetermined changing condition is met.

20 Claims, 19 Drawing Sheets

(56) References Cited

U.S. PATENT DOCUMENTS

| | | | | |
|---|---|---|---|---|
| 8,561,985 | B2 * | 10/2013 | Ishizaki | B65H 7/06 399/21 |
| 9,104,165 | B2 * | 8/2015 | Eguchi | G03G 15/70 |
| 2008/0304866 | A1 | 12/2008 | Takenaka et al. | |
| 2011/0116822 | A1 | 5/2011 | Takenaka et al. | |
| 2016/0334747 | A1 | 11/2016 | Wakabayashi et al. | |
| 2017/0185025 | A1 | 6/2017 | Wakabayashi et al. | |
| 2021/0214176 | A1 * | 7/2021 | Fukushima | B65H 3/0669 |

FOREIGN PATENT DOCUMENTS

| | | |
|---|---|---|
| JP | 2006-039336 | 2/2006 |
| JP | 2014-052522 | 3/2014 |

* cited by examiner

SHEET CONVEYING DEVICE AND IMAGE FORMING APPARATUS INCORPORATING THE SHEET CONVEYING DEVICE

CROSS-REFERENCE TO RELATED APPLICATION

This patent application is based on and claims priority pursuant to 35 U.S.C. § 119(a) to Japanese Patent Application No. 2020-006247, filed on Jan. 17, 2020, in the Japan Patent Office, the entire disclosure of which is hereby incorporated by reference herein.

BACKGROUND

Technical Field

Embodiments of the present disclosure relate to a sheet conveying device and an image forming apparatus incorporating the sheet conveying device.

Related Art

Various types of sheet conveying devices are known to include a pair of rollers that holds a sheet to be conveyed, a biasing member that biases one roller of the pair of rollers toward the other roller of the pair of rollers, and a biasing force changer to change a biasing force by the biasing member.

For example, a sheet conveying device is known that includes a pair of rollers in which a conveying roller is pressed against a conveyance roller to form a nip. In the sheet conveying device, when a sheet jam is detected, an arm member is operated by a solenoid of a nip release mechanism, and a shaft of the conveyance roller is moved in a direction away from the conveying roller. As a result, the nip pressure between the conveying roller and the conveyance roller is released, and the nip pressure (biasing force) acting between the conveying roller and the conveyance roller is reduced to a low state.

SUMMARY

According to an aspect of the present disclosure, there is provided a sheet conveying device that includes a pair of rollers, a biasing member, a biasing force changer, control circuitry, an operation detector, and a notification device. The pair of rollers includes a first roller and a second roller configured to hold a sheet conveyed between the first roller and the second roller. The biasing member is configured to bias the first roller toward the second roller. The biasing force changer is configured to change a biasing force of the biasing member. The control circuitry is configured to, when a predetermined changing condition is met, cause the biasing force changer to change the biasing force and cause the pair of rollers to convey the sheet. The operation detector is configured to detect a changing operation of the biasing force changer. The notification device is configured to notify an abnormality of the changing operation when the operation detector detects the abnormality of the changing operation. The control circuitry is configured to, when the operation detector detects the abnormality of the changing operation, perform sheet conveyance control to cause the pair of rollers to convey the sheet without causing the biasing force changer to change the biasing force, regardless of whether the predetermined changing condition is met.

According to another aspect of the present disclosure, there is provided an image forming apparatus that includes the sheet conveying device and an image forming device configured to form an image on the sheet conveyed by the sheet conveying device.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
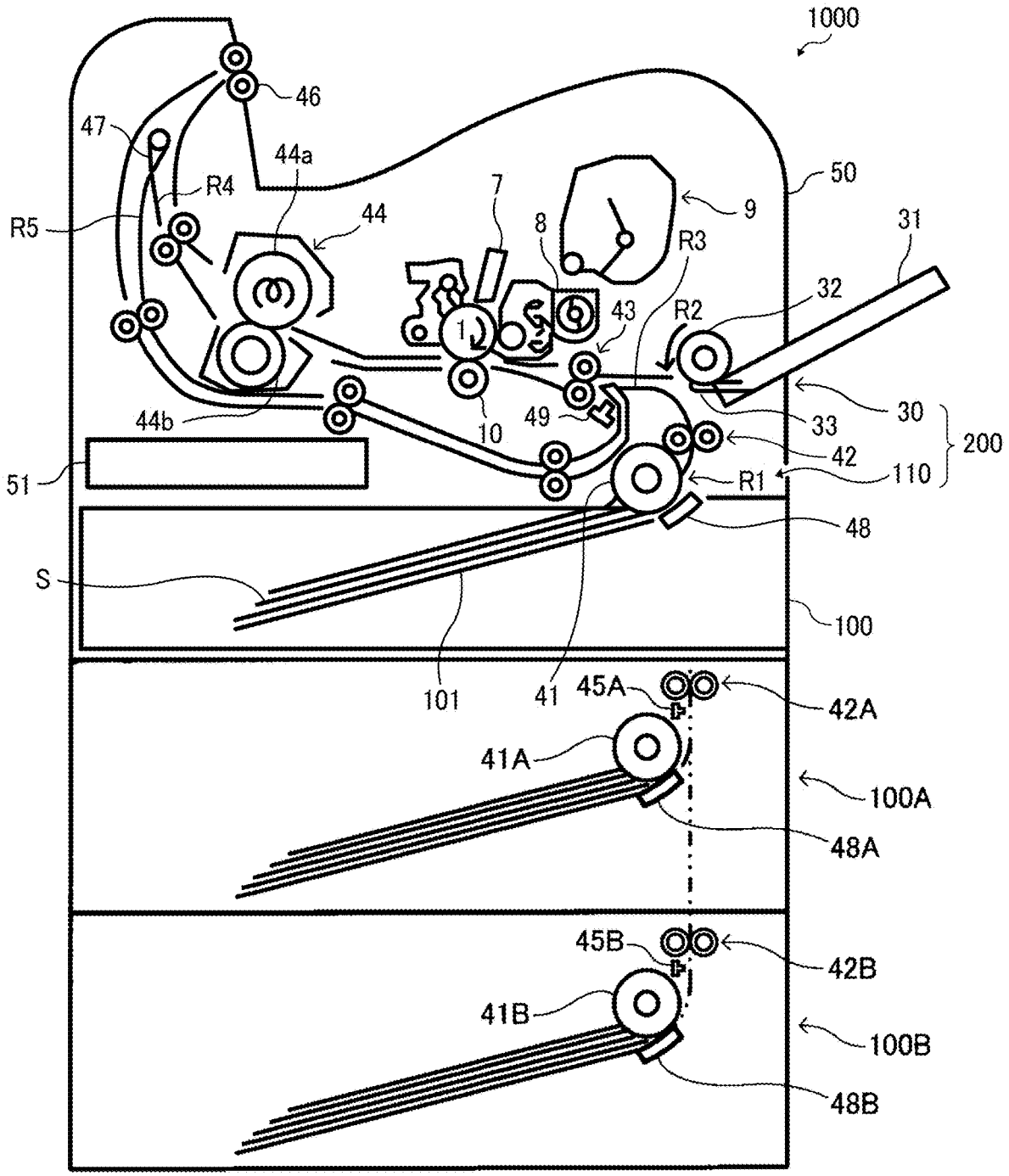
FIG. 1 is a diagram illustrating a schematic configuration of an image forming apparatus according to an embodiment of this disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present disclosure. As used herein, the singular forms "a", "an" and "the" are intended to include the plural forms as well, unless the context clearly indicates otherwise.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

With reference to drawings, descriptions are given below of embodiments of the present disclosure. It is to be noted that elements (for example, mechanical parts and components) having the same functions and shapes are denoted by the same reference numerals throughout the specification and redundant descriptions are omitted.

Now, an example of an electrophotographic printer that forms an image by electrophotography is described as an electrophotographic image forming apparatus according to an embodiment of the present disclosure.

At first, a description is given of a basic configuration of an image forming apparatus 1000 according to an embodiment of this disclosure, with reference to FIG. 1. FIG. 1 is a schematic diagram illustrating the image forming apparatus 1000 according to an embodiment of this disclosure. In FIG. 1, the image forming apparatus 1000 according to the present embodiment of this disclosure includes a main-body housing 50, a photoconductor 1, a regular sheet tray 100, and two additional sheet trays, that is, a first additional sheet tray 100A and a second additional sheet tray 100B. The photoconductor 1 functions as an image bearer or a latent image bearer. Each of the regular sheet tray 100, the first additional sheet tray 100A, and the second additional sheet tray 100B functions as a sheet container that is detachably attachable with respect to the main-body housing 50. Each of the regular sheet tray 100 and the additional sheet trays 100A and 100B contains a plurality of recording sheets S as a sheet bundle that includes a recording sheet S.

As a sheet feed roller 41 is driven to rotate, a recording sheet S is fed from the regular sheet tray 100. When a plurality of recording sheets S is fed from the regular sheet tray 100, an uppermost recording sheet S alone is separated from the other recording sheets S in a sheet separation nip region formed between the sheet feed roller 41 and a sheet separation pad 48, and is continuously conveyed toward downstream in a sheet conveyance direction in which the recording sheet S is conveyed. Then, the recording sheet S (i.e., the uppermost recording sheet S) reaches a regular sheet conveyance passage R1 that functions as a first sheet conveyance passage. Thereafter, the recording sheet S is gripped (held) in a sheet conveyance nip region formed by a pair of relay rollers 42 that functions as a pair of upper conveyance rollers, so that the recording sheet S is conveyed from upstream toward downstream in the sheet conveyance direction in the regular sheet conveyance passage R1. Note that the pair of conveyance rollers may be a pair of conveyance bodies, at least one of which is a belt.

As a sheet feed roller 41A is driven to rotate, a recording sheet S is fed from the first additional sheet tray 100A. When a plurality of recording sheets S is fed from the first additional sheet tray 100A, an uppermost recording sheet S alone is separated from the other recording sheets S in a sheet separation nip region formed between the sheet feed roller 41A and a sheet separation pad 48A. Thereafter, the recording sheet S is nipped (held) in a sheet conveyance nip region formed by a pair of upper conveyance rollers 42A and is conveyed upward to reach a regular sheet conveyance passage R1 through the regular sheet tray 100.

As a sheet feed roller 41B is driven to rotate, a recording sheet S is fed from the second additional sheet tray 100B. When a plurality of recording sheets S is fed from the second additional sheet tray 100B, an uppermost recording sheet S alone is separated from the other recording sheets S in a sheet separation nip region formed between the sheet feed roller 41B and a sheet separation pad 48B. Thereafter, the recording sheet S is nipped (held) in a sheet conveyance nip region formed by a pair of upper conveyance rollers 42B and is conveyed upward to reach the regular sheet conveyance passage R1 through the first additional sheet tray 100A and the regular sheet tray 100.

The downstream end of the regular sheet conveyance passage R1 communicates with a common sheet conveyance passage R3. A pair of registration rollers 43 is provided in the common sheet conveyance passage R3. A registration sensor 49 that detects the recording sheet S is provided in the common sheet conveyance passage R3, being disposed upstream from the pair of registration rollers 43 in the sheet conveyance direction. When the recording sheet S reaches the pair of registration rollers 43, the recording sheet S is stopped temporality in a state in which the leading end of the recording sheet S is in contact with the registration nip region of the pair of registration rollers 43 that is stopped. While the leading end of the recording sheet S contacts the pair of registration rollers 43, skew of the recording sheet S is corrected. Note that the registration sensor 49 is also used for an initial operation and a confirmation operation to check whether there is a remaining recording sheet S when cancelling an abnormal stop of the image forming apparatus 1000 (paper jam detection operation).

The pair of registration rollers 43 starts rotating in synchrony with conveyance of the recording sheet S at a timing at which the recording sheet S contacts the surface of the photoconductor 1 to receive a toner image on the surface of the photoconductor 1 in the sheet transfer nip region. Then, the recording sheet S is conveyed toward the sheet transfer nip region. At this time, the pair of relay rollers 42 starts rotating simultaneously with the start of rotation of the pair of relay rollers 42, so as to start conveyance of the recording sheet S that has been temporarily stopped.

The image forming apparatus 1000 includes a bypass sheet feeder 30 in the main-body housing 50. The bypass sheet feeder 30 includes a bypass sheet tray 31, a bypass sheet feed roller 32, a sheet separation pad 33, a bypass bottom plate 34, and a bypass bottom plate cam 35. A detailed description of the bypass sheet feeder 30 is given below. The recording sheet S placed on the bypass sheet tray 31 of the bypass sheet feeder 30 is fed from the bypass sheet tray 31 along with rotation of the bypass sheet feed roller 32 that functions as a sheet feed roller to feed the recording sheet S, to a bypass sheet conveyance passage R2 that functions as a second sheet conveyance passage. The downstream end of the bypass sheet conveyance passage R2 and the downstream end of the regular sheet conveyance passage R1 meet with a common sheet conveyance passage R3. The recording sheet S fed out by the bypass sheet feed roller 32 passes the sheet separation nip region formed by contact of the bypass sheet feed roller 32 and the sheet separation pad 33 in the bypass sheet conveyance passage R2. Then, the recording sheet S is conveyed to the common sheet conveyance passage R3 to be conveyed to the pair of registration rollers 43. Thereafter, similar to the recording sheet S fed from the regular sheet tray 100, the recording sheet S fed from the bypass sheet tray 31 passes the pair of registration rollers 43 to be conveyed to the transfer nip region.

Figure 2:
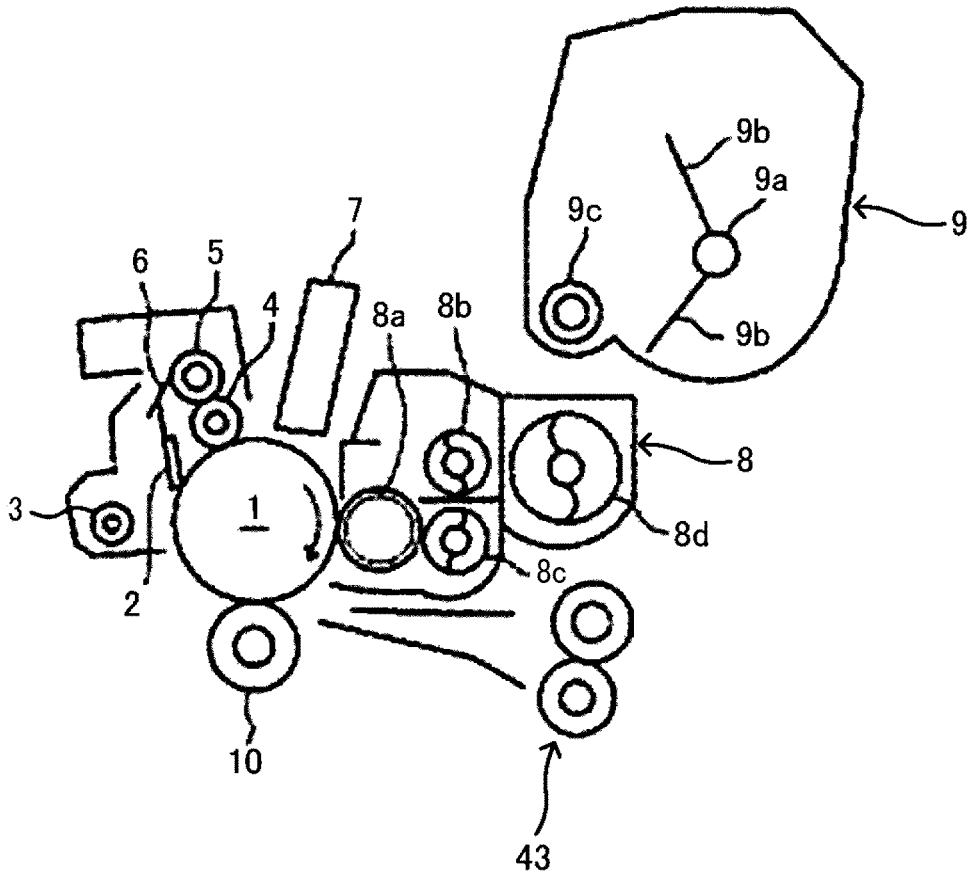
FIG. 2 is an enlarged view illustrating an image forming mechanism including a photoconductor and image forming units disposed around the photoconductor included in the image forming apparatus of FIG. 1.

FIG. 2 is an enlarged view illustrating an image forming mechanism including the photoconductor 1 and the image forming units disposed around the photoconductor 1 included in the image forming apparatus 1000. To be more specific, a cleaning blade 2, a toner collection screw 3, a charging roller 4, a charging roller cleaning roller 5, a scraper 6, a latent image writing device 7, a developing device 8, and a transfer roller 10 are provided as the image forming units around the drum-shaped photoconductor 1 which is rotated in a clockwise direction in FIG. 2. The photoconductor 1 and the image forming units integrally function as an image forming device. The charging roller 4 includes a conductive rubber roller and forms a charging nip region by rotating while contacting the photoconductor 1. The charging roller 4 is applied with a charging bias that is output from a power source for the charging roller 4. As a result, the surface of the photoconductor 1 is uniformly charged by the charging bias generated between the surface of the photoconductor 1 and the surface of the charging roller 4 in the charging nip region.

The latent image writing device 7 includes an LED (light-emitting diode) array and performs light scanning with LED light over the surface of the photoconductor 1 that has been uniformly charged. As the latent image writing device 7 emits laser light beams onto the uniformly charged surface of the photoconductor 1, the electric potential of the irradiated (exposed) region of the charged surface of the photoconductor 1 attenuate, so that an electrostatic latent image is formed on the surface of the photoconductor 1.

As the photoconductor 1 rotates, the electrostatic latent image passes through a development region that formed between the surface of the photoconductor 1 and the developing device 8 when the photoconductor 1 is brought to face the developing device 8. The developing device 8 includes a developer circulation conveyance portion and a developing portion. The developer circulation conveyance portion includes developer that contains non-magnetic toner and magnetic carriers. The developer circulation conveyance portion includes a first screw 8*b* for conveying the developer to be supplied to a developing roller 8*a*, a second screw 8*c* for conveying the developer in an independent space positioned beneath the first screw 8*b*. The developer circulation conveyance portion further includes an inclined screw 8*d* for receiving the developer from the second screw 8*c* and supplying the developer to the first screw 8*b*. The developing roller 8*a*, the first screw 8*b*, and the second screw 8*c* are placed at attitudes parallel with each other. By contrast, the inclined screw 8*d* is placed at an attitude inclined with respect to the developing roller 8*a*, the first screw 8*b*, and the second screw 8*c*.

As the first screw 8*b* rotates, the first screw 8*b* conveys the developer from a far side toward a near side in a direction perpendicular to the drawing sheet of FIG. 2. At this time, the first screw 8*b* supplies a portion of the developer to the developing roller 8*a* that is disposed opposite to the first screw 8*b*. The developer having been conveyed by the first screw 8*b* to the vicinity of a far end portion of the first screw 8*b* in the direction perpendicular to the drawing sheet of FIG. 2 is dropped onto the second screw 8*c*.

While receiving used developer from the developing roller 8*a*, the second screw 8*c* conveys the received developer from the far side toward the near side in the direction perpendicular to the drawing sheet of FIG. 2, along with rotation of the second screw 8*c*. The developer conveyed by the second screw 8*c* to the vicinity of a near end portion of the second screw 8*c* in the direction perpendicular to the drawing sheet of FIG. 2 is supplied to the inclined screw 8*d*. Further, along with rotation of the inclined screw 8*d*, the developer is conveyed from the far side toward the near side in the direction perpendicular to the drawing sheet of FIG. 2. Thereafter, the developer is supplied to the first screw 8*b* in the vicinity of the far end portion of the first screw 8*b* in the direction perpendicular to the drawing sheet of FIG. 2.

The developing roller 8*a* includes a developing sleeve and a magnet roller. The developing sleeve is a tubular-shaped rotatable non-magnetic member. The magnet roller is fixed to the developing sleeve in such a way as not to rotate together with the developing sleeve. Part of the developer that is conveyed by the first screw 8*b* is scooped up by the surface of the developing sleeve due to magnetic force generated by the magnet roller. The developer, which is carried onto the surface of the developing sleeve, is conveyed along with rotation of the developing sleeve and passes through an opposing position at which the developing sleeve and a doctor blade are disposed facing each other. According to this structure, the thickness of a layer of the developer on the surface of the developing sleeve is regulated while the developer is rotated together with rotation of the surface of the development sleeve. Thereafter, the developing roller 8*a* moves (rotates) while sliding on the surface of the photoconductor 1 in a development region in which the developing roller 8*a* is brought to face the photoconductor 1.

A development bias having the same polarity as the toner and as a uniformly charged electric potential (a background electric potential) on the surface of the photoconductor 1 is applied to the developing sleeve. The absolute value of this development bias is greater than the absolute value of the electric potential of the latent image and is smaller than the absolute value of the background electric potential on the background surface of the photoconductor 1. Therefore, in the development region, a development potential acts between the electrostatic latent image formed on the photoconductor 1 and the developing sleeve of the developing device 8, so as to electrostatically move the toner from the developing sleeve to the electrostatic latent image on the surface of the photoconductor 1. By contrast, a background potential acts between the background surface of the photoconductor 1 and the development sleeve of the developing device 8, so as to electrostatically move the toner from the photoconductor 1 to the developing sleeve. This action of the background potential causes the toner to selectively adhere to the electrostatic latent image formed on the surface of the photoconductor 1, so that the electrostatic latent image is developed in the development region.

The developer that has passed through the development region enters an opposite region in which the developing sleeve faces the second screw 8*c* as the developing sleeve rotates. In the opposite region, a repulsive magnetic field is formed by two magnetic poles having polarities different from each other out of multiple magnetic poles included in the magnet roller. The developer that has entered the opposite region is separated from the surface of the developing sleeve due to the effect of the repulsive magnetic field and is collected by the second screw 8*c*.

The developer that is conveyed by the inclined screw 8*d* contains the developer that has been collected from the developing roller 8*a*, and this collected developer is contributed to development in the development region, so that the toner concentration is lowered. The developing device 8 includes a toner concentration sensor that detects the toner concentration of the developer to be conveyed by the inclined screw 8*d*. Based on detection results obtained by the toner concentration sensor, a controller 51 outputs a replenishment operation signal for replenishing the toner to the developer that is conveyed by the inclined screw 8*d*, accordingly. The controller 51 functions as circuitry that includes semiconductor circuits such as a central processing unit (CPU).

A toner cartridge 9 is disposed above the developing device 8. The toner cartridge 9 contains toner and agitates the toner with agitators 9*b* fixed to a rotary shaft 9*a*. Further, a toner replenishment member 9*c* is driven to rotate according to the replenishment operation signal output from the controller 51. With this operation, an amount of the toner corresponding to an amount of rotation of the toner replenishment member 9*c* is replenished to the inclined screw 8*d* of the developing device 8.

The toner image formed on the surface of the photoconductor 1 as a result of the development by the developing device 8 enters the transfer nip region where the photoconductor 1 and the transfer roller 10 contact each other along with rotation of the photoconductor 1. An electric bias having the opposite polarity to the latent image electric potential of the photoconductor 1 is applied to the transfer roller 10. Accordingly, a transfer bias is formed within the transfer nip region.

As described above, the pair of registration rollers 43 conveys the recording sheet S toward the transfer nip region in synchrony with a timing at which the toner image formed on the photoconductor 1 is overlaid onto the sheet S in the transfer nip region. Due to the transfer bias and the nip pressure, as the recording sheet S is brought to closely contact with the toner image formed on the photoconductor 1 at the transfer nip region, the toner image is transferred onto the recording sheet S.

Residual toner that is not transferred onto the recording sheet S remains on the surface of the photoconductor 1 after having passed through the transfer nip region. After being scraped off from the surface of the photoconductor 1 by the cleaning blade 2 that is in contact with the photoconductor 1, the residual toner is conveyed by the toner collection screw 3, toward a waste toner bottle.

The surface of the photoconductor 1 that is cleaned by the cleaning blade 2 is electrically discharged by an electric discharging device. Thereafter, the surface of the photoconductor 1 is uniformly charged again by the charging roller 4. Foreign materials such as toner additive agents and the toner that has not been removed by the cleaning blade 2 remain on the charging roller 4 that is in contact with the surface of the photoconductor 1. These foreign materials are shifted to the charging roller cleaning roller 5 that is in contact with the charging roller 4, and then are scraped off from the surface of the charging roller cleaning roller 5 by the scraper 6 that is in contact with the charging roller cleaning roller 5. The foreign materials scraped off from the surface of the charging roller cleaning roller 5 falls onto the toner collection screw 3.

In FIG. 1, the recording sheet S, which has passed through the transfer nip region formed by the photoconductor 1 and the transfer roller 10 contacting each other, is conveyed to a fixing device 44. The fixing device 44 includes a fixing roller 44*a* and a pressure roller 44*b*. The fixing roller 44*a* includes a heat generating source 44*c* such as a halogen lamp. The pressure roller 44*b* is pressed against the fixing roller 44*a*. The fixing roller 44*a* and the pressure roller 44*b* contact each other to form a fixing nip region. The toner image is fixed to the surface of the recording sheet S that is held in the fixing nip region due to application of heat and pressure. Thereafter, the recording sheet S that has passed through the fixing device 44 passes through a sheet ejection passage R4. Then, the recording sheet S is held in a sheet ejection nip region formed by a pair of sheet ejection rollers 46.

The image forming apparatus 1000 switches printing modes between a single-side printing mode for performing single-side printing and a duplex printing mode for performing duplex printing. In the single-side printing mode, the image forming apparatus 1000 produces an image on one side of the recording sheet S. By contrast, the image forming apparatus 1000 prints respective images on both sides of the recording sheet S in the duplex printing mode. In the single-side printing mode or in the duplex printing mode in which images are formed on both sides of the recording sheet S, the pair of sheet ejection rollers 46 continues rotating in a forward direction and a reverse direction alternately, so that the recording sheet S in the sheet ejection passage R4 is ejected out of the image forming apparatus 1000. After passing through the fixing device 44, the recording sheet S is stacked on a sheet stacker provided on the top face of the main-body housing 50 of the image forming apparatus 1000.

By contrast, in the duplex printing mode when an image is formed on one side of the recording sheet S, the pair of sheet ejection rollers 46 is rotated in the reverse direction at the timing at which the trailing end of the recording sheet S enters the sheet ejection nip region of the pair of sheet ejection rollers 46. At this time, a switching claw 47 disposed near the downstream end of the sheet ejection passage R4 moves to block (close) the sheet ejection passage R4 and open an entrance of a reverse conveyance passage R5 at the same time. As the recording sheet S starts reversing by the reverse rotation of the pair of sheet ejection rollers 46, the recording sheet S is conveyed to the reverse sheet conveyance passage R5. The downstream end of the reverse sheet conveyance passage R5 meets the common sheet conveyance passage R3 on the upstream side from the pair of registration rollers 43 in the sheet conveyance direction. After being conveyed in the reverse sheet conveyance passage R5, the recording sheet S is conveyed to the pair of registration rollers 43 in the common sheet conveyance passage R3 again. Then, after a toner image has been formed on the other side of the recording sheet S in the transfer nip region, the recording sheet S passes through the fixing device 44, the sheet ejection passage R4, and the pair of sheet ejection rollers 46 and is then ejected to the outside of the main-body housing 50 of the image forming apparatus 1000.

Figure 3:
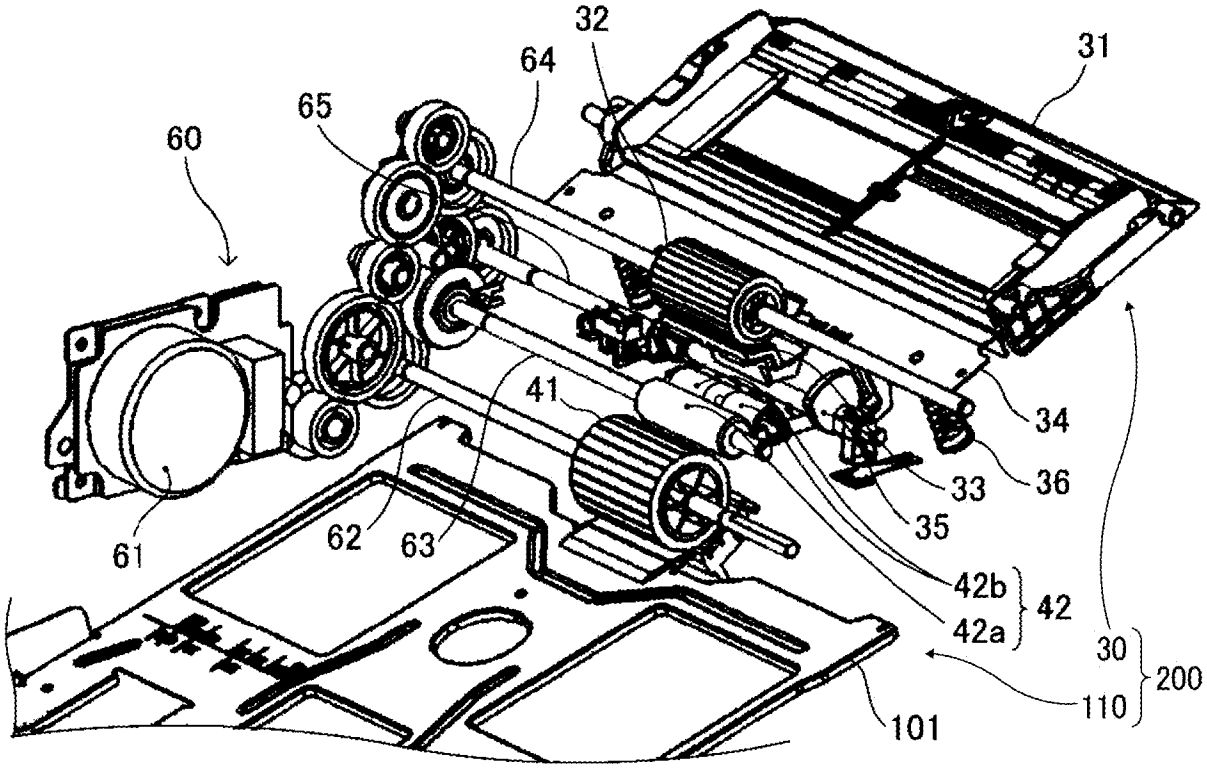
FIG. 3 is a perspective view illustrating the main configuration of a sheet conveying device including a regular sheet feeder to feed a recording sheet from a sheet tray and a bypass sheet feeder to feed a recording sheet from a bypass tray in the image forming apparatus.
Figure 4:
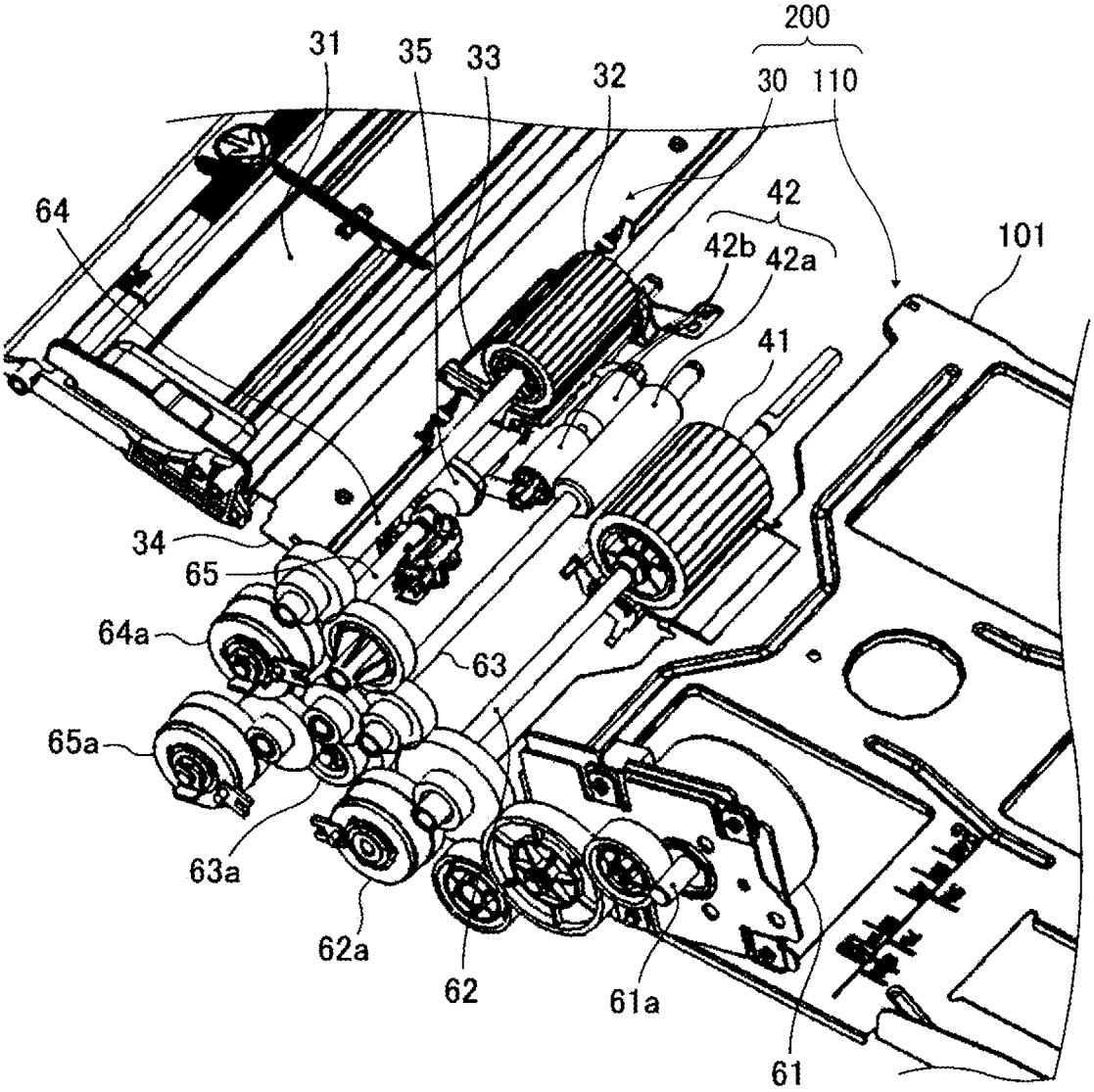
FIG. 4 is a perspective view illustrating a configuration of a drive mechanism in the sheet conveying device for driving the regular sheet feeder and the bypass sheet feeder.

Next, a description is given of the configuration and operations of a sheet conveying device that conveys the recording sheet S. FIG. 3 is a perspective view illustrating the main configuration of a sheet conveying device 200 including a regular sheet feeder 110 to feed a recording sheet S from the regular sheet tray 100 a bypass sheet feeder 30 to feed a recording sheet S from the bypass sheet tray 31 in the image forming apparatus 1000. FIG. 4 is a perspective view illustrating a configuration of a drive mechanism in the sheet conveying device 200 for driving the regular sheet feeder 110 and the bypass sheet feeder 30.

As illustrated in FIGS. 3 and 4, the drive mechanism of the regular sheet feeder 110 and the bypass sheet feeder 30 has a configuration in which a single main motor 61 applies driving force to be transmitted (distributed) to the sheet feed roller 41, the pair of relay rollers 42, the bypass sheet feed roller 32, and the bypass bottom plate cam 35. To be more specific, the driving force output from a motor shaft 61*a* of the main motor 61 that functions as a drive source is transmitted, via various idler gears, to a sheet feed roller shaft 62 mounted with the sheet feed roller 41, a relay roller shaft 63 mounted on the pair of relay rollers 42, a bypass sheet feed roller shaft 64 mounted on the bypass sheet feed roller 32, and a bypass bottom plate cam shaft 65 mounted with the bypass bottom plate cam 35. In other words, the sheet feed roller shaft 62, the relay roller shaft 63, the bypass sheet feed roller shaft 64, and the bypass bottom plate cam shaft 65 receive the driving force from the motor shaft 61*a* of the main motor 61.

The sheet feed roller shaft 62, the relay roller shaft 63, the bypass sheet feed roller shaft 64, and the bypass bottom plate cam shaft 65 includes respective clutches 62*a*, 63*a*, 64*a*, and 65*a* to turn on and off transmission of the driving force. When each clutch is turned on, the driving force is transmitted to rotate the sheet feed roller shaft 62, the relay roller shaft 63, the bypass sheet feed roller shaft 64, and the bypass bottom plate cam shaft 65. By contrast, when each clutch is turned off, transmission of the driving force is interrupted, and therefore the sheet feed roller shaft 62, the relay roller shaft 63, the bypass sheet feed roller shaft 64, and the bypass bottom plate cam shaft 65 do not rotate. Note that the driving force of the main motor 61 is also transmitted to the pair of registration rollers 43 via a registration clutch for the pair of registration rollers 43. In the present embodiment, the controller 51 controls turning on and off of each clutch (i.e., the clutches 62*a*, 63*a*, 64*a*, and 65*a*) using the driving force of the main motor 61, so as to perform conveyance of the recording sheet S. In other words, the controller 51 controls conveyance of the recording sheet S.

Figure 5:
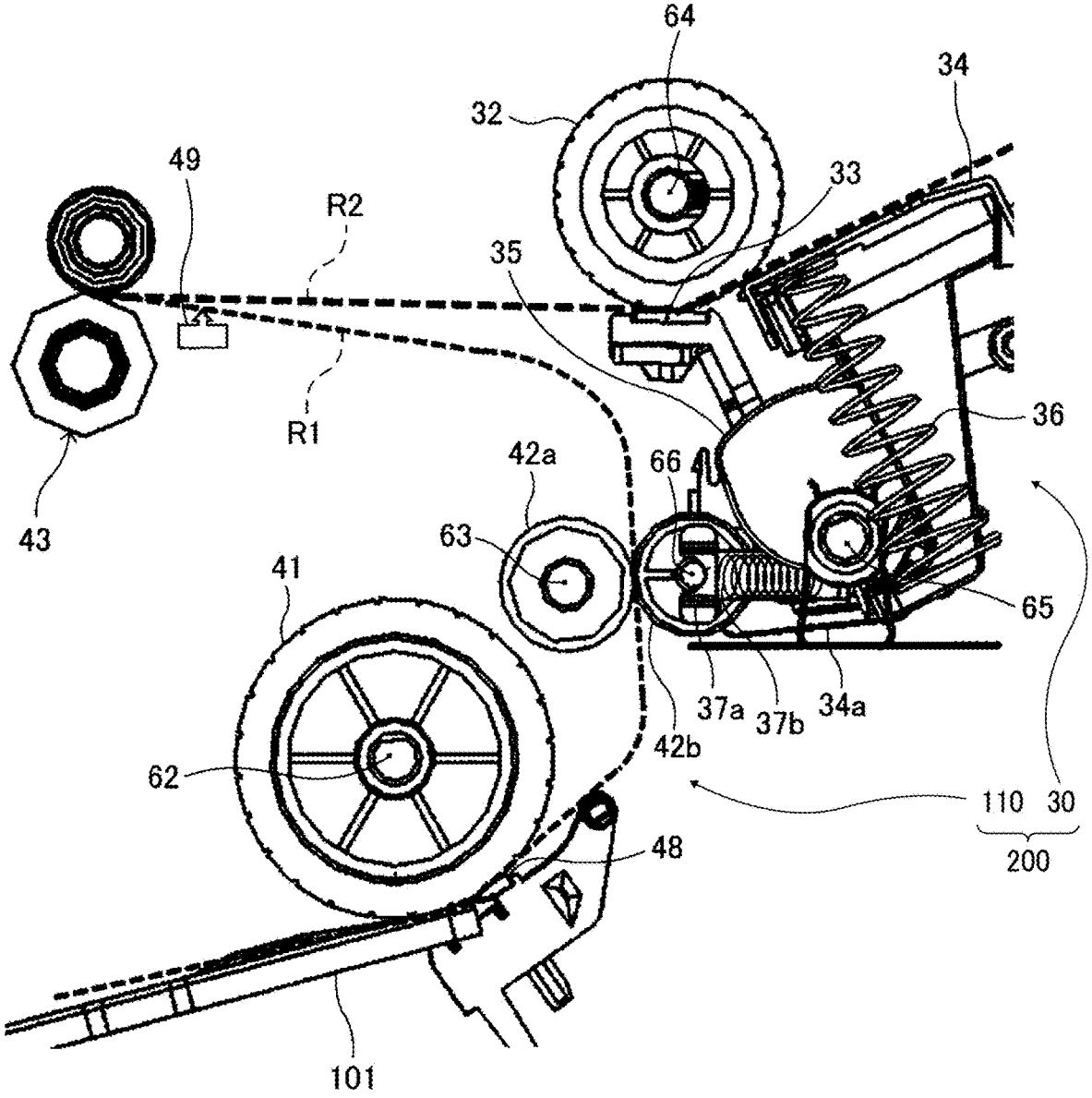
FIG. 5 is a diagram for explaining a sheet conveyance passage in the regular sheet feeder and a sheet conveyance passage in the bypass sheet feeder.
Figure 6:
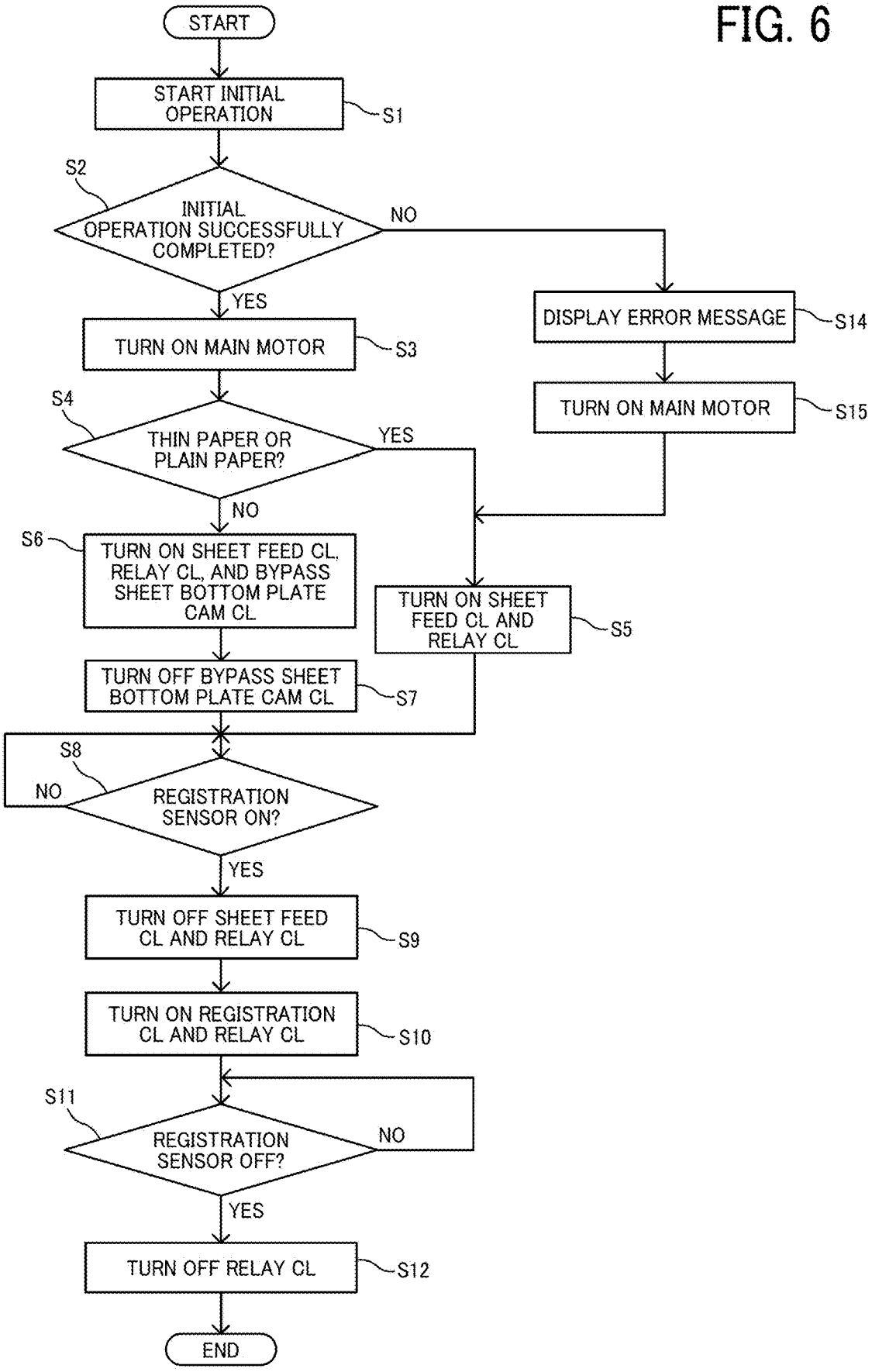
FIG. 6 is a flowchart of a control operation of sheet conveyance from the regular sheet feeder.
Figure 13:
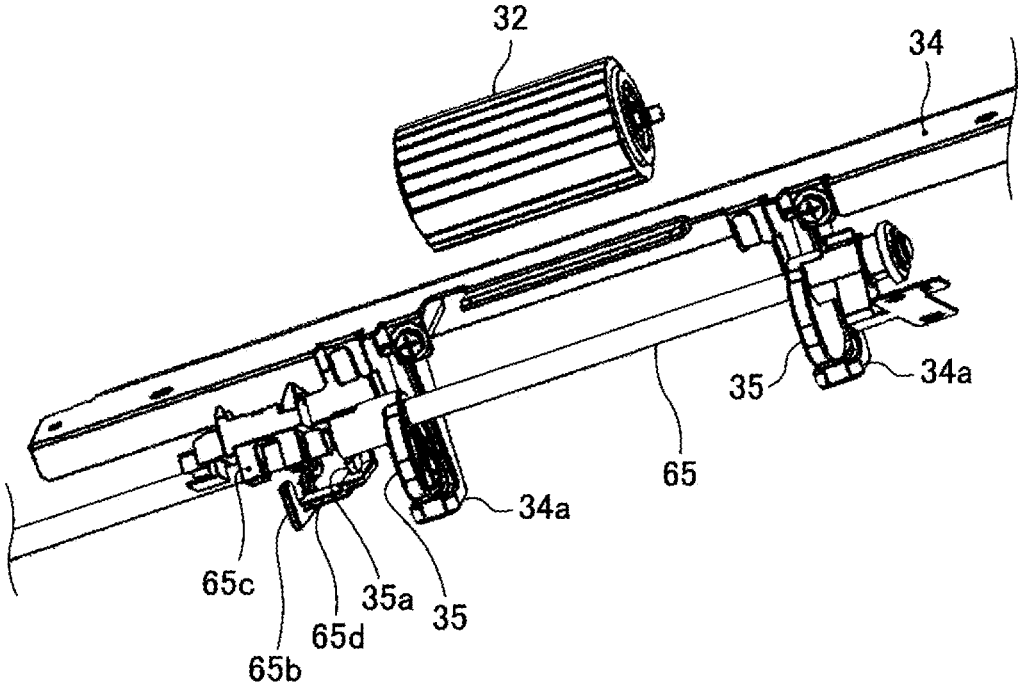
FIG. 13 is a perspective view illustrating a state in which a bypass bottom plate is separated from the bypass sheet feed roller.

FIG. 5 is a diagram illustrating a sheet conveyance passage in the regular sheet feeder 110 and a sheet conveyance passage in the bypass sheet feeder 30. FIG. 6 is a flowchart of a control operation of sheet conveyance from the regular sheet feeder 110. First, a description is given of conveyance of the recording sheet S from the regular sheet feeder 110, with reference to the flowchart of FIG. 6. The regular sheet feeder 110 includes a regular sheet feeder bottom plate 101 that is biased upward toward the sheet feed roller 41. Since the regular sheet feeder bottom plate 101 is biased as described above, the sheet feed roller 41 is in contact with an uppermost recording sheet S of the plurality of recording sheets S loaded in a form of a sheet bundle on the regular sheet feeder bottom plate 101. When the sheet feeding and conveyance from the regular sheet feeder is started, the controller 51 first executes an initial operation (step S1) and confirms whether the initial operation is successfully completed (step S2). Here, the "initial operation" is an operation of setting the bypass bottom plate 34 to the lowermost position (see FIG. 13, part (a) of FIG. 17, and FIG. 18A). After the initial operation is completed, the nip pressure of the pair of relay rollers 42 is set to a low state. Details of the initial operation are described later.

When the initial operation is successfully completed (YES in step S2), the controller 51 turns on the main motor 61 (step S3), and then determines whether the recording sheet S to be fed is a thin paper or a plain paper (step S4). In the present embodiment, a user operates the operation panel of the image forming apparatus 1000, so that one type of sheet among various types of sheets printable in the image forming apparatus 1000, for example, plain paper (or a (thin) sheet having a relatively low strength), thin paper (or a (thin) sheet having a relatively low strength), and thick paper (or a (thick) sheet having a relatively high strength) is selected as the recording sheet S contained in the regular sheet tray 100. The selection result is stored in a memory of the controller 51. In the process step S4 in the present embodiment, the controller 51 determines whether the recording sheet S to be fed is a thin paper or a plain paper based on the selection result stored in the memory.

Note that a method of determination of whether the sheet is thin paper, plain paper, or thick paper is not limited to this method of determination. For example, a sheet thickness detection sensor may detect the thickness of the recording sheet S contained in the regular sheet tray 100 or the thickness of the recording sheet S fed from the regular sheet tray 100 and the controller 51 may determine the type of the sheet based on the detection result.

Further, in the present embodiment, the type of the recording sheet S that is a determination target is determined based on the difference in the thickness of the recording sheet S. However, the type of the recording sheet S may be determined based on the difference in the characteristics that affect the difference in the strength of the recording sheet S or in the sheet conveyance load of the recording sheet S, for example, the difference in the material or size of the recording sheet S.

In the present embodiment, when the controller 51 has determined the recording sheet S is thin paper or plain paper (YES in step S4), the nip pressure of the pair of relay rollers 42 has been lowered due to the above-described initial operation. Therefore, the controller 51 turns on the regular sheet feed clutch (CL) 62*a* and the relay clutch (CL) 63*a* while maintaining the low state of the nip pressure (step S5). Consequently, as the sheet feed roller 41 rotates, the uppermost recording sheet S in the regular sheet tray 100 is fed toward the sheet separation pad 48. At this time, even if the second and subsequent recording sheets S are fed together with the uppermost recording sheet S, the conveyance of the second and subsequent recording sheets S is hindered by the frictional force with the sheet separation pad 48, and the uppermost recording sheet S alone passes the sheet separation pad 48. Note that, while the recording sheet S is fed (conveyed) from the regular sheet feeder 110, no recording sheet S is conveyed from the bypass sheet feeder 30. Therefore, the bypass sheet feed clutch 64*a* and the bypass bottom plate cam clutch 65*a* are remained in an OFF state.

By contrast, when the controller 51 has determined the recording sheet S is not a thin paper or a plain paper, in other words, when the controller 51 has determined the recording sheet S is a thick paper (NO in step S4), the controller 51 performs a process operation to increase the nip pressure of the pair of relay rollers 42. To be more specific, since the nip pressure of the pair of relay rollers 42 is low during the initial operation, the controller 51 also turns on the bypass bottom plate cam clutch (CL) 65*a* (step S6). Accordingly, the bypass bottom plate cam shaft 65 is driven to rotate clockwise in FIG. 5. After a predetermined time has elapsed, the bypass bottom plate cam clutch 65*a* is turned off (step S7), thus stopping the rotation of the bypass bottom plate cam shaft 65.

Further, a relay driven roller 42*b* that is the other of the pair of relay rollers 42 has a roller shaft 66 that is received by a bearing 37*a*. As illustrated in FIG. 5, the relay driven roller 42*b* is biased by a biasing force of a pressure spring 37*b* that is a compression spring at the bearing 37*a*, so that the relay driven roller 42*b* is in contact with the relay drive roller 42*a* due to the biasing force of the pressure spring 37*b*. In the state in which the bypass bottom plate cam shaft 65 is stopped at the above-described rotational position, the amount of contraction of the pressure spring 37*b* increases, and therefore the nip pressure of the pair of relay rollers 42 is adjusted to the high nip pressure state. Note that a detailed description of the configuration to change (adjust) the nip pressure of the pair of relay rollers 42 is deferred.

In the sheet conveyance from the regular sheet feeder in the present embodiment, the timing at which the bypass bottom plate cam clutch 65*a* is turned on is the same as the timing at which the regular sheet feed clutch 62*a* and the relay clutch 63*a* are turned on (step S6). This is because of the following reason.

The change of the nip pressure between the rollers of the pair of relay rollers 42 need be completed before the leading edge of the recording sheet S reaches the pair of relay rollers 42 from the start of feeding of the recording sheet S. When the recording sheet S is fed from the regular sheet tray 100, the conveyance distance from the regular sheet tray 100 to the pair of relay rollers 42 is short. Therefore, the changing of the nip pressure cannot be completed before the leading edge of the recording sheet S reaches the pair of relay rollers 42 unless the changing operation of the nip pressure of the rollers of the pair of relay rollers 42 is started simultaneously with the start of the sheet feeding from the regular sheet tray 100.

In the present embodiment, the recording sheet S fed from the regular sheet tray 100 is conveyed along the regular sheet conveyance passage R1 illustrated in FIG. 5. At this time, a relay drive roller 42*a* that is one of the pair of relay rollers 42 is driven to rotate by the driving force of the main motor 61. Further, the relay driven roller 42*b* that is the other of the pair of relay rollers 42 is biased by the biasing force of the pressure spring 37*b* at the bearing 37*a* that receives a roller shaft 66 of the pair of relay rollers 42. To be more specific, the relay driven roller 42*b* is biased by the relatively low biasing force of the pressure spring 37*b* at the bearing 37*a* when the recording sheet S is a thin paper or a plain paper or by the relatively high biasing force of the pressure spring 37*b* at the bearing 37*a* when the recording sheet S is a thick paper. The relay driven roller 42*b* is in contact with the relay drive roller 42*a* due to the biasing force of the pressure spring 37*b*. Accordingly, the relay driven roller 42*b* is rotated along with rotation of the relay drive roller 42*a*. The recording sheet S conveyed through the regular sheet conveyance passage R1 is conveyed in a state in which the recording sheet S is sandwiched (held) in a relay nip region by the relay drive roller 42*a* and the relay driven roller 42*b*.

When the leading end of the recording sheet S reaches the registration sensor 49, the controller 51 determines whether the registration sensor 49 has turned on (step S8). When the registration sensor 49 has turned on (YES in step S8), the controller 51 turns off the regular sheet feed clutch 62*a* and the relay clutch 63*a* after a given time has elapsed (before the leading end of the recording sheet S reaches the pair of registration rollers 43) (step S9). The given time is, for example, 100 ms from the turning on of the registration sensor 49. After step S9, conveyance of the recording sheet S is temporarily stopped. Accordingly, the leading end of the recording sheet S contacts the registration nip region of the pair of registration rollers 43 that has been stopped, so that skew of the recording sheet S is corrected.

Then, the controller 51 turns on the relay clutch 63*a* and the registration clutch at a timing at which the recording sheet S is overlaid on the toner image formed on the surface of the photoconductor 1 in the transfer nip region (step S10). The timing is, for example, 200 ms after the controller 51 has turned off the regular sheet feed clutch 62*a* and the relay clutch 63*a*. Accordingly, the controller 51 starts the pair of registration rollers 43 and the pair of relay rollers 42 to rotate to convey the recording sheet S toward the transfer nip region. At this time, since the regular sheet feed clutch 62*a* remains off, the sheet feed roller 41 is not rotated. Even in a state in which the trailing end of the recording sheet S is sandwiched (held) between the sheet feed roller 41 and the sheet separation pad 48, the sheet feed roller 41 is rotated along with movement of the recording sheet S conveyed by the conveyance force of the pair of registration rollers 43 and the conveyance force of the pair of relay rollers 42. Therefore, conveyance of the recording sheet S is not hindered. Then, the controller 51 determines whether the registration sensor 49 is turned off (step S11). When the trailing end of the recording sheet S reaches the registration sensor 49 and the registration sensor 49 is turned off (YES in step S11), the controller 51 turns off the relay clutch 63*a* (step S12) to stop rotation of the pair of relay rollers 42.

In the present embodiment, the biasing force by the pressure spring 37*b* is changed between a case in which the recording sheet S is thin paper or plain paper and a case in which the recording sheet S is thick paper, and the nip pressure of the pair of relay rollers 42 is changed to a pressure suitable for each case. In such a manner, the nip pressure is set to be high for thick paper, thus achieving stable conveyance performance. The nip pressure is set to be low for thin paper or plain paper, thus restraining the sheet to be easily torn when the sheet nipped by the pair of relay rollers 42 is pulled out at the time of paper jam. Thus, the jam removal operation can be facilitated.

Here, in the regular sheet feeding in the present embodiment, at the time of the initial operation (step S1), the bypass bottom plate cam shaft 65 is driven by one rotation to confirm whether the changing of the nip pressure of the pair of relay rollers 42 normally operates. When the initial operation is not successfully completed (NO in step S2), the controller 51 displays a failure message on the operation panel of the image forming apparatus (step S14), and executes processing of notifying an abnormality in the changing operation of the nip pressure of the pair of relay rollers 42. The notification method is not limited to visually notifying the abnormality by displaying a failure message on the operation panel, and may be audibly notifying the abnormality by, for example, voice. The notification timing may be immediately notified, or may be notified at a delayed timing such as after the operation of the image forming apparatus is finished.

Conventionally, in a case in which the initial operation is not normally completed, it is generally determined that the sheet cannot be conveyed and the image forming operation is prohibited until the abnormality is solved by an operation of a user, a service person, or the like. Accordingly, downtime in which image formation cannot be performed occurs.

However, even in a situation in which the changing operation of the nip pressure of the pair of relay rollers 42 is not normally performed (in a case in which the initial operation is not normally completed), the sheet conveyance is not completely impossible. For example, various sheet conveyance conditions such as the setting value of the nip pressure to be changed and the sheet conveyance speed can be adjusted. Thus, even when the sheet conveyance is continued in a state in which the changing operation of the nip pressure is not performed, the sheet conveyance cane be performed without causing a problem in a short period.

For example, at the start of the image forming operation, as described above, the nip pressure of the pair of relay rollers 42 is in a low state. Even in a case in which thick paper is fed and conveyed in such a state, for example, slip more than usual may occur or large skew may occur, thus reducing stable conveyance performance. However, the sheet conveyance itself can be continued in a short period of time (for example, until an input print job ends). Further, even if thin paper or plain paper is fed and conveyed in a state in which the nip pressure of the pair of relay rollers 42 is high, the sheet conveyance itself can be continued although there is a problem of a decrease in workability at the time of jam removal. Accordingly, the sheet conveyance can be continued in a short period of time (for example, until an input print job is completed).

Hence, in the present embodiment, when the initial operation is not successfully completed (NO in step S2), the controller 51 displays a failure message on the operation panel of the image forming apparatus (step S14) and continues sheet conveyance regardless of the type of sheet. For example, the controller 51 turns on the main motor 61 (step S15), and turns on the regular sheet feed clutch 62*a* and the relay clutch 63*a* (step S5) without determining whether the recording sheet S to be fed is thin paper or plain paper. Accordingly, as the sheet feed roller 41 is driven to rotate, the uppermost recording sheet S in the regular sheet tray 100 is fed toward the sheet separation pad 48. The recording sheet S conveyed in the regular sheet conveyance passage R1 is conveyed in a state in which the recording sheet S is sandwiched (held) in a relay nip region by the pair of relay rollers 42.

At this time, when the recording sheet S to be conveyed is thin paper or plain paper, the nip pressure of the pair of relay rollers 42 is normally in a low state, and thus no problem occurs. Even in a situation in which the nip pressure of the pair of relay rollers 42 is high, the sheet conveyance itself can be continued although there is a disadvantage of a decrease in workability at the time of jam removal. Therefore, the sheet conveyance can be continued in a short period of time.

On the other hand, when the recording sheet S to be conveyed is thick paper, the nip pressure of the pair of relay rollers 42 is usually in a low state. Therefore, the sheet conveyance can be continued in a short period of time although there is a decrease in stable conveyance performance. If the nip pressure of the pair of relay rollers 42 is in a high state, no problem occurs.

Figure 7A:
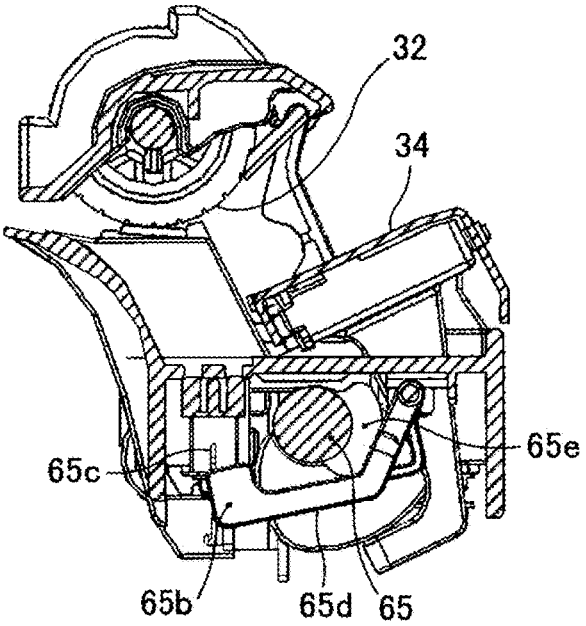
FIGS. 7A and 7B are diagrams each illustrating an operation detector to detect the changing operation of a biasing force changer that changes a biasing force of a pressure spring that presses a bearing of a relay driven roller toward a relay drive roller.
Figure 7B:
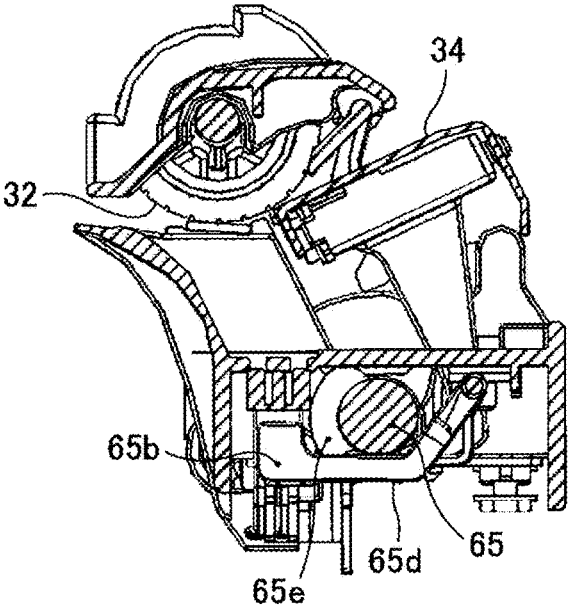

Next, the initial operation is described. FIGS. 7A and 7B are diagrams each illustrating the operation detector to detect the changing operation of the biasing force changer that changes the biasing force of the pressure spring 37*b* that presses the bearing 37*a* of the relay driven roller 42*b* toward the relay drive roller 42*a*. In the present embodiment, as the bypass bottom plate cam shaft 65 is driven to rotate, a pressing portion 65*e* integrated with the bypass bottom plate cam 35 can take a pressing position at which the pressing portion 65*e* contacts and pushes down a push-down lever 65*d* that pushes down a cam detection feeler 65*b* as illustrated in FIG. 7A and a non-pressing position at which the pressing portion 65*e* does not contact the push-down lever 65*d* as illustrated in FIG. 7B. Thus, a cam detection feeler 65*b* can take a state of not blocking a feeler sensor 65*c* as illustrated in FIG. 7A and a state of blocking the feeler sensor 65*c* as illustrated in FIG. 7B. The output of the feeler sensor 65*c* is acquired by the controller 51.

As illustrated in FIG. 7A, in a state in which the cam detection feeler 65*b* blocks the feeler sensor 65*c*, the output of the feeler sensor 65*c* is in an off state. The rotation position of the bypass bottom plate cam shaft 65 is a position at which the bypass bottom plate 34 is lowered (a position at which the bypass bottom plate 34 is separated from the bypass sheet feed roller 32). At this time, the pressing portion 65*e* on the bypass bottom plate cam shaft 65 is located at the non-pressing position. At this time, a pressure plate 37*d* moves in a direction away from the relay drive roller 42*a* by the biasing force of the pressure spring 37*b*. Accordingly, as the pressure spring 37*b* expands, the amount of contraction decreases and the biasing force of the pressure spring 37*b* decreases. Thus, the biasing force to bias the relay driven roller 42*b* toward the relay drive roller 42*a* is reduced, and the nip pressure of the pair of relay rollers 42 is lowered.

On the other hand, as illustrated in FIG. 7B, in a state in which the cam detection feeler 65*b* does not block the feeler sensor 65*c*, the output of the feeler sensor 65*c* is in an on state. The rotation position of the bypass bottom plate cam shaft 65 is a position at which the bypass bottom plate 34 is raised (a position at which the bypass bottom plate 34 contacts the bypass sheet feed roller 32). At this time, the pressing portion 65*e* on the bypass bottom plate cam shaft 65 is located at the pressing position. At this time, the pressure plate 37*d* is pressed by the pressing portion 65*e* and moves in a direction approaching the relay drive roller 42*a*. Accordingly, the pressure spring 37*b* contracts, and thus the biasing force of the pressure spring 37*b* increases. As a result, the biasing force that biases the relay driven roller 42*b* toward the relay driving roller 42*a* increases, and thus the nip pressure of the pair of relay rollers 42 increases.

As described above, the controller 51 can detect whether the operation of changing the nip pressure of the pair of relay rollers 42 (i.e., changing the biasing force of the pressure spring 37*b*) is normally performed, based on the output of the feeler sensor 65*c*. In the initial operation of the present embodiment, the controller 51 confirms whether the changing of the nip pressure of the pair of relay rollers 42 normally operates, based on the output of the feeler sensor 65*c*.

Figure 8A:
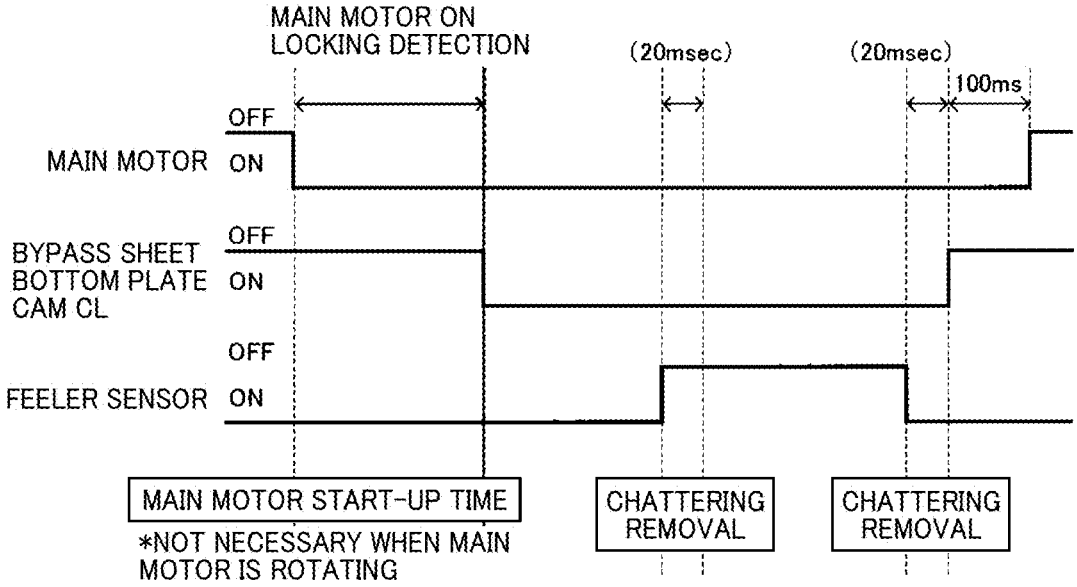
FIGS. 8A and 8B are timing charts illustrating outputs of a main motor, a bypass bottom plate cam clutch, and a feeler sensor.
Figure 8B:
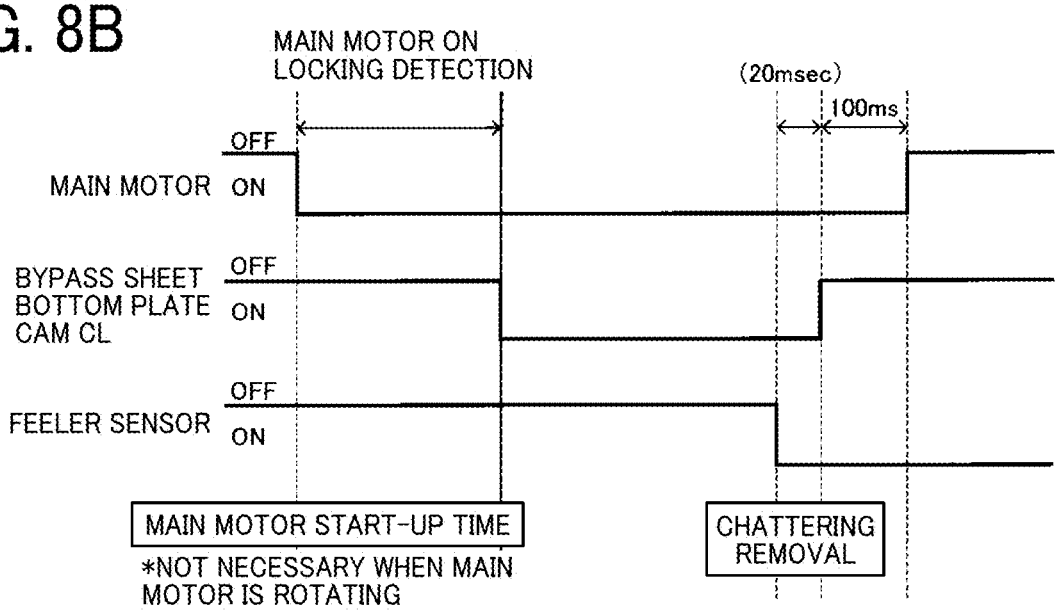

FIG. 8A is a timing chart illustrating the outputs of the main motor 61, the bypass bottom plate cam clutch 65*a*, and the feeler sensor 65*c* when the output of the feeler sensor 65*c* before the initial operation is ON. FIG. 8B is a timing chart illustrating the outputs of the main motor 61, the bypass bottom plate cam clutch 65*a*, and the feeler sensor 65*c* when the output of the feeler sensor 65*c* before the initial operation is OFF.

In the initial operation of the present embodiment, cases are classified according to the output state of the feeler sensor 65*c* before the initial operation. When the output state of the feeler sensor 65*c* does not change within a predetermined time, the controller 51 determines that there is an abnormality. The initial operation is performed, for example, when the image forming apparatus is powered on or when a door 39 is opened or closed.

Figure 9:
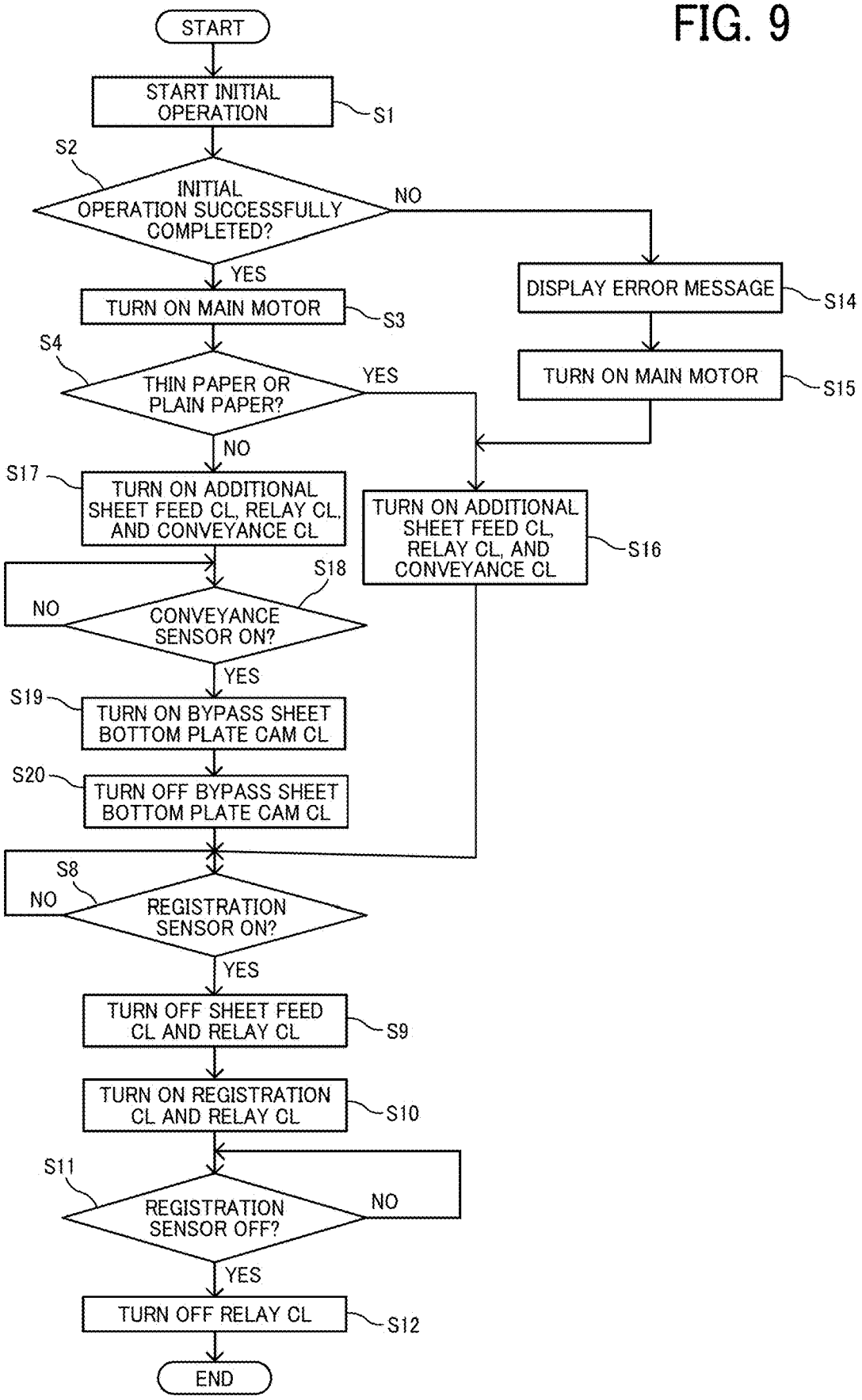
FIG. 9 is a flowchart illustrating a control operation in the case of feeding and conveying a sheet from an additional sheet feeder.

Next, with reference to a flow chart illustrated in FIG. 9, a description is given of a case in which a sheet is fed and conveyed from an additional sheet feeder including the additional sheet trays 100A and 100B. In the present embodiment, in a case in which the nip pressure of the pair of relay rollers 42 is changed when regular sheet feeding is performed from the regular sheet tray 100, as described above, the conveyance distance from the regular sheet tray 100 to the pair of relay rollers 42 is short. Therefore, the bypass bottom plate cam clutch 65*a* is turned on at the timing when the regular sheet feed clutch 62*a* and the relay clutch 63*a* are turned on, and the changing operation of the nip pressure is started. However, when additional sheet feeding is performed from the additional sheet trays 100A and 100B, as illustrated in FIG. 1, the conveyance distance from each of the additional sheet trays 100A and 100B to the pair of relay rollers 42 is long and the additional sheet trays 100A and 100B are provided with conveyance sensors 45A and 45B as sheet detectors. Thus, the bypass bottom plate cam clutch 65*a* is turned on based on the detection timing of the conveyance sensors 45A and 45B to start the changing operation of the nip pressure.

Hereinafter, a case in which a sheet is fed and conveyed from the first additional sheet tray 100A is described as an example. When the sheet feeding and conveyance from the first additional sheet tray 100A is started, similarly with the case of the regular sheet feeding, the controller 51 performs an initial operation (step S1) and confirms whether the initial operation is successfully completed (step S2). When the initial operation is successfully completed (YES in step S2), the controller 51 turns on the main motor 61 (step S3), and then determines whether the recording sheet S to be fed is a thin paper or a plain paper (step S4).

When the controller 51 has determined the recording sheet S is a thin paper or a plain paper (YES in step S4), the nip pressure of the pair of relay rollers 42 has been lowered due to the above-described initial operation. Therefore, the controller 51 turns on an additional sheet feed clutch, a conveyance clutch, and the relay clutch 63*a* while maintaining the low state of the nip pressure. The additional sheet feed clutch and the conveyance clutch transmit the driving force of the main motor 61 to the additional sheet feed roller 41A and the pair of conveyance rollers 42A, respectively, of the first additional sheet tray 100A (step S16). Thus, the additional sheet feed roller 41A is driven to rotate, and the uppermost recording sheet S in the first additional sheet tray 100A is fed out.

By contrast, when the controller 51 has determined the recording sheet S is not a thin paper or a plain paper, in other words, when the controller 51 has determined the recording sheet S is a thick paper (NO in step S4), the controller 51 performs a process operation to increase the nip pressure of the pair of relay rollers 42. For example, the controller 51 first turns on the additional sheet feed clutch, the conveyance clutch, and the relay clutch 63*a* (step S17), and rotationally drives the additional sheet feed roller 41A to feed the uppermost recording sheet S in the first additional sheet tray 100A. When the leading end of the fed recording sheet S is detected by the conveyance sensor 45A of the first additional sheet tray 100A (step S18), the bypass bottom plate cam clutch 65*a* is turned on (step S19) and the bypass bottom plate cam shaft 65 is driven to rotate. After a predetermined time has elapsed, the bypass bottom plate cam clutch 65*a* is turned off (S20), and the rotation of the bypass bottom plate cam shaft 65 is stopped. Thus, the nip pressure of the rollers of the pair of relay rollers 42 is changed to a high state.

Thereafter, the fed recording sheet S is conveyed to the pair of relay rollers 42 through the regular sheet feeder. Further, the relay driven roller 42*b* that is the other of the pair of relay rollers 42 is biased by the biasing force of the pressure spring 37*b* at the bearing 37*a* that receives a roller shaft 66 of the pair of relay rollers 42. To be more specific, the relay driven roller 42*b* is biased by the relatively low biasing force of the pressure spring 37*b* at the bearing 37*a* when the recording sheet S is a thin paper or a plain paper or by the relatively high biasing force of the pressure spring 37*b* at the bearing 37*a* when the recording sheet S is a thick paper. The relay driven roller 42*b* is in contact with the relay drive roller 42*a* due to the biasing force of the pressure spring 37*b*. Accordingly, the relay driven roller 42*b* is rotated along with rotation of the relay drive roller 42*a*. The recording sheet S conveyed through the regular sheet conveyance passage R1 is conveyed in a state in which the recording sheet S is sandwiched (held) in a relay nip region by the relay drive roller 42*a* and the relay driven roller 42*b*.

In the present embodiment, even when sheets are fed and conveyed from the additional sheet trays 100A and 100B, the nip pressure is set to be high for thick paper, thus achieving stable conveyance performance. The nip pressure is set to be low for thin paper or plain paper, thus restraining the sheet to be easily torn when the sheet nipped by the pair of relay rollers 42 is pulled out at the time of paper jam. Thus, the jam removal operation can be facilitated.

When sheets are continuously fed from the additional sheet trays 100A and 100B as in the continuous image forming operation, the controller 51 may cause the sheet interval to be shorter than the prescribed interval. When the controller 51 determines that the sheet interval is shorter than the prescribed interval based on the detection signals of the sheet detectors (the conveyance sensors 45A and 45B, the registration sensor 49, and the like) on the conveyance passage, the controller 51 stops the conveyance of the subsequent sheet.

For example, in the example of feeding and conveying from the second additional sheet tray 100B, the controller 51 measures the sheet interval between a preceding recording sheet S1 and the following recording sheet S2, from the timing when the trailing end of the preceding recording sheet S1 passes the conveyance sensor 45A of the first additional sheet tray 100A and the timing when the leading end of the following recording sheet S2 (i.e., the recording sheet fed from the second additional sheet tray 100B) reaches the conveyance sensor 45B of the second additional sheet tray 100B, and determines whether the sheet interval is shorter than the prescribed interval. If the controller 51 determines that the sheet interval is shorter than the prescribed interval, the controller 51 causes the conveyance of the following recording sheet S2 to stop immediately after the timing when the leading edge of the following recording sheet S2 reaches the conveyance sensor 45A of the first additional sheet tray 100A, and causes the following recording sheet S2 to stand by. Thereafter, when the sheet interval with the preceding recording sheet S1 is ensured to be equal to or more than the prescribed interval, the controller 51 restarts the conveyance of the following recording sheet S2.

At the time of this restart, the conveyance distance from the standby position of the recording sheet S2 to the pair of relay rollers 42 is short. Accordingly, if the bypass bottom plate cam clutch 65*a* is turned on simultaneously with the restart to start the changing operation of the nip pressure, the recording sheet S2 may reach the pair of relay rollers 42 before the changing of the nip pressure of the pair of relay rollers 42 is completed. In such a case, it is preferable to restart the conveyance of the recording sheet S2 after a predetermined time has elapsed from turning-on of the bypass bottom plate cam clutch 65*a*.

Figure 10:
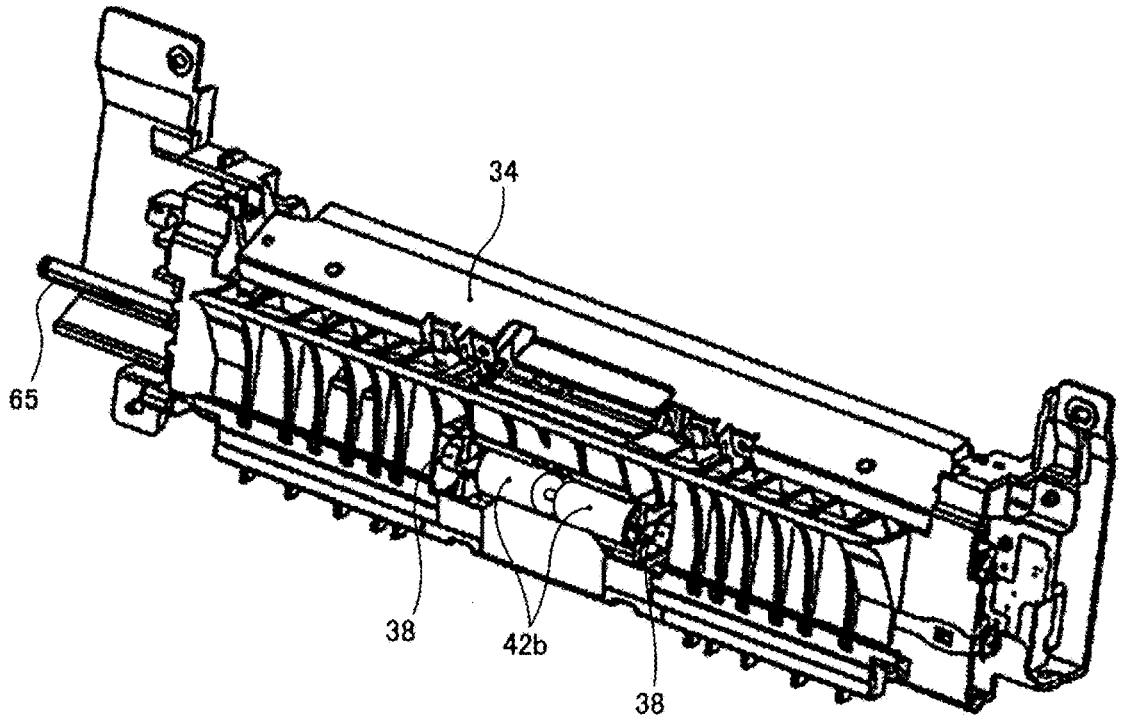
FIG. 10 is an external perspective view illustrating a state in which the bypass tray is removed from the bypass sheet feeder.
Figure 11:
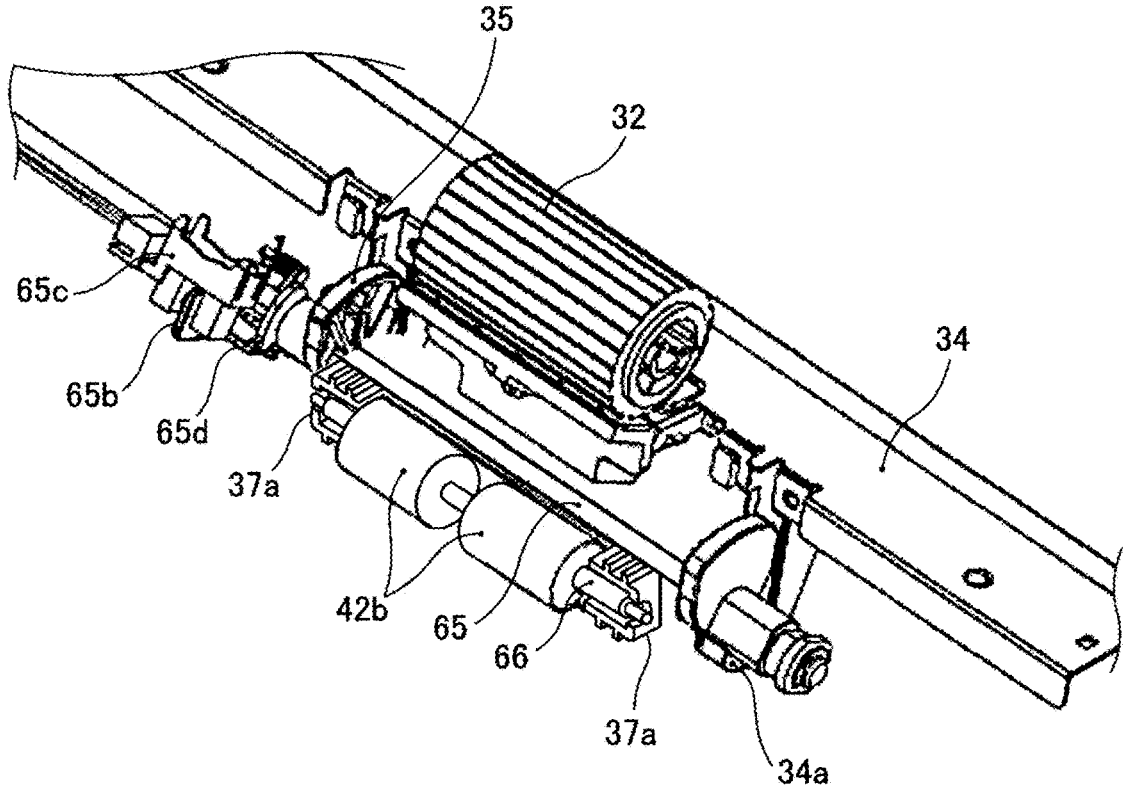
FIG. 11 is a perspective view illustrating a main part of the bypass sheet feeder.
Figure 12:
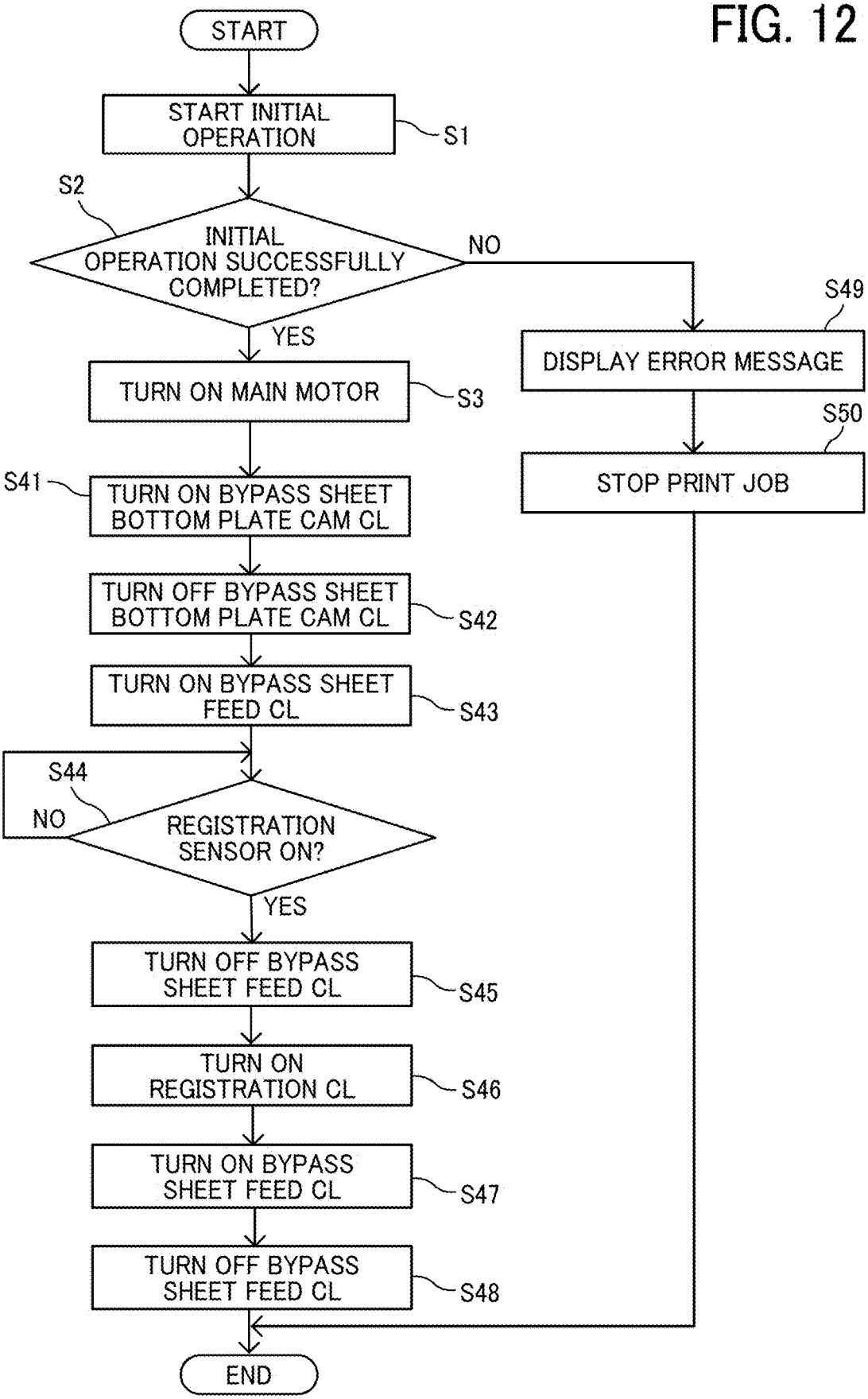
FIG. 12 is a flowchart of a control operation of sheet conveyance from the bypass sheet feeder.

Next, a description is given of conveyance of the recording sheet S from the bypass sheet feeder 30, with reference to FIGS. 10 to 12. FIG. 10 is an external perspective view illustrating a state in which the bypass sheet tray 31 is removed from the bypass sheet feeder 30. FIG. 11 is a perspective view illustrating the main configuration of the bypass sheet feeder 30. FIG. 12 is a flowchart of a control operation of sheet conveyance from the bypass sheet feeder 30.

The bypass bottom plate 34 is biased by a bottom plate spring 36 upward toward the bypass sheet feed roller 32 that is disposed facing the bypass bottom plate 34. Further, as illustrated in FIG. 11, a bottom plate guide 34*a* is provided on the bypass bottom plate 34, at a portion facing the bypass bottom plate cam 35. As the bypass bottom plate cam shaft 65 rotates, the bypass bottom plate cam 35 contacts the bottom plate guide 34*a* to press down the bottom plate guide 34*a* (see FIG. 13). By so doing, the bypass bottom plate 34 lowers against the biasing force of the bottom plate spring 36 to separate from the bypass sheet feed roller 32.

When the sheet feeding and conveyance from the bypass sheet feeder 30 is started, first, the controller 51 also executes an initial operation (step S1) and confirms whether the initial operation is successfully completed (step S2). When the initial operation is successfully completed (YES in step S2), the controller 51 turns on the main motor 61 (step S3), turns on the bypass bottom plate cam clutch 65*a* (step S41), and turns off the bypass bottom plate cam clutch 65*a* (step S42) after a prescribed time has elapsed. Accordingly, the bypass bottom plate cam shaft 65 is rotated, so that the bypass bottom plate 34 is biased by the biasing force of the bottom plate spring 36 toward the bypass sheet feed roller 32. As a result, the bypass sheet feed roller 32 is in contact with the uppermost recording sheet S of the plurality of recording sheets S loaded in a form of a sheet bundle on the bypass sheet tray 31 and the bypass bottom plate 34. The bypass sheet tray 31 and the bypass bottom plate 34 are coupled to each other, each of which functioning as a sheet loader.

Subsequently, the controller 51 turns on the bypass sheet feed clutch 64*a* (step S43). Consequently, as the bypass sheet feed roller 32 rotates, the uppermost recording sheet S on the bypass bottom plate 34 is fed toward the sheet separation pad 33. At this time, even if the second and subsequent recording sheets S are fed together with the uppermost recording sheet S, the conveyance of the second and subsequent recording sheets S is hindered by the frictional force with the sheet separation pad 33, and the uppermost recording sheet S alone passes the sheet separation pad 33.

Note that, while the recording sheet S is fed (conveyed) from the bypass sheet feeder 30, no recording sheet S is conveyed from the regular sheet feeder 110. Therefore, the regular sheet feed clutch 62*a* and the relay clutch 63*a* are remained in an OFF state.

Thereafter, the recording sheet S that is fed from the bypass sheet tray 31 is conveyed along the bypass sheet conveyance passage R2 in FIG. 5. When the leading end of the recording sheet S reaches the registration sensor 49, the controller 51 determines whether the registration sensor 49 has turned on (step S44). When the registration sensor 49 has turned on (YES in step S44), the controller 51 turns off the bypass sheet feed clutch 64*a* after a given time has elapsed (before the leading end of the recording sheet S reaches the pair of registration rollers 43) (step S45). After step S45, conveyance of the recording sheet S is temporarily stopped. Accordingly, the leading end of the recording sheet S contacts the registration nip region of the pair of registration rollers 43 that has been stopped, so that skew of the recording sheet S is corrected.

Then, the controller 51 turns on the registration clutch at a timing at which the recording sheet S is overlaid on the toner image formed on the surface of the photoconductor 1 in the transfer nip region (step S46). Accordingly, the controller 51 starts the pair of registration rollers 43 to rotate to convey the recording sheet S toward the transfer nip region.

As illustrated in FIG. 10, the bypass sheet feeder 30 in the present embodiment has a unit structure in which the relay driven roller 42*b*, which is one of the pair of relay rollers 42, is supported integrally with a bypass sheet feeding mechanism. This unit structure including the relay driven roller 42*b* and the bypass sheet feeding mechanism is screwed and fixed to the housing 50 of the image forming apparatus 1000. On the other hand, the relay drive roller 42*a* that is the other roller of the pair of relay rollers 42 is supported by the main-body housing 50 of the image forming apparatus 1000. Therefore, in the present embodiment, the relay driven roller 42*b* that is provided in the unit and the relay drive roller 42*a* that is provided in the main-body housing 50 of the image forming apparatus 1000 are configured so as not to be separated from each other.

Figure 14A:
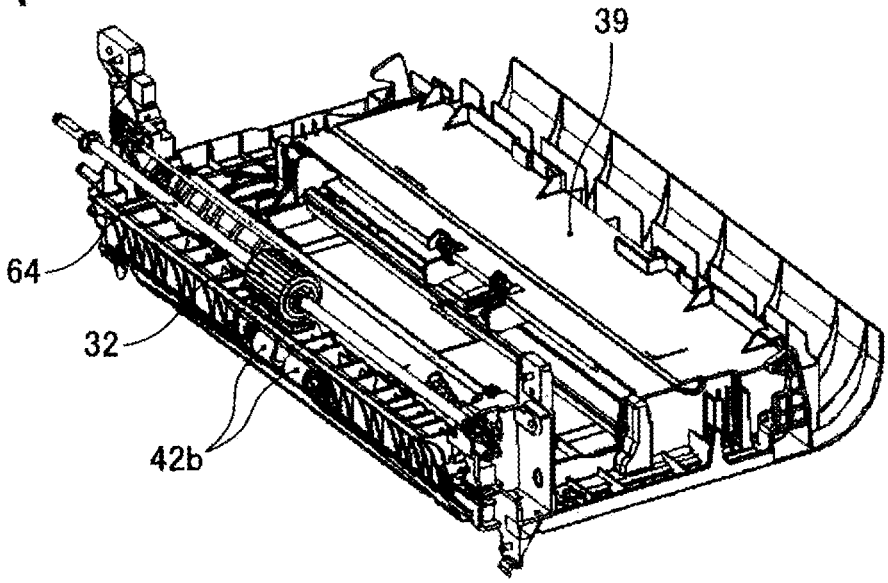
FIGS. 14A and 14B are perspective views each illustrating a door to which the bypass tray is attached is open from the housing of the image forming apparatus.
Figure 14B:
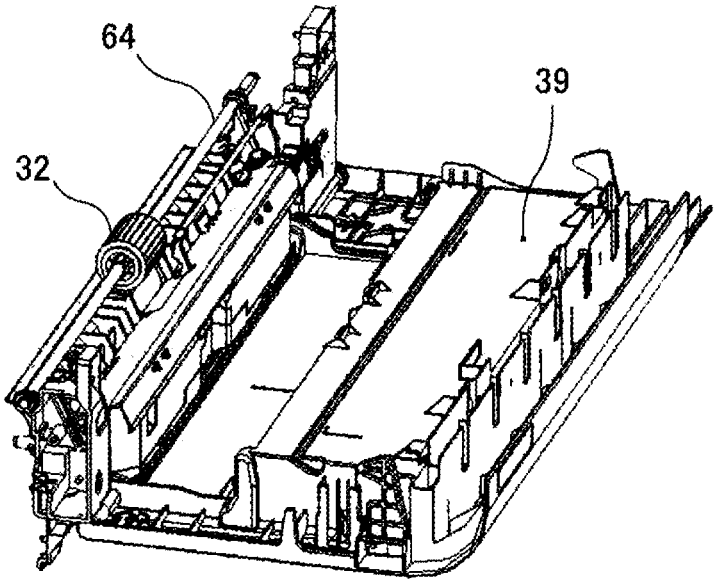
Figure 15A:
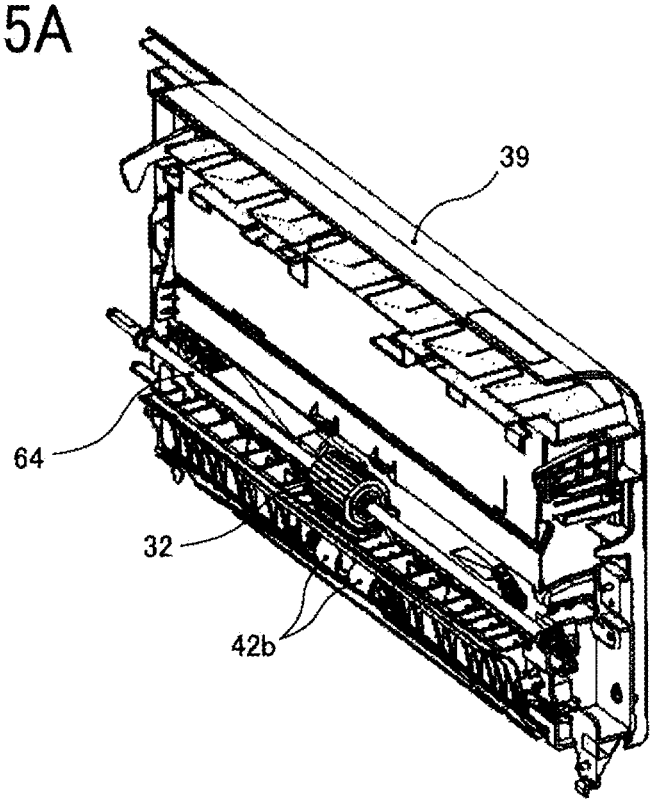
FIGS. 15A and 15B are perspective views each illustrating the door to which the bypass tray is attached is closed to the housing of the image forming apparatus.
Figure 15B:
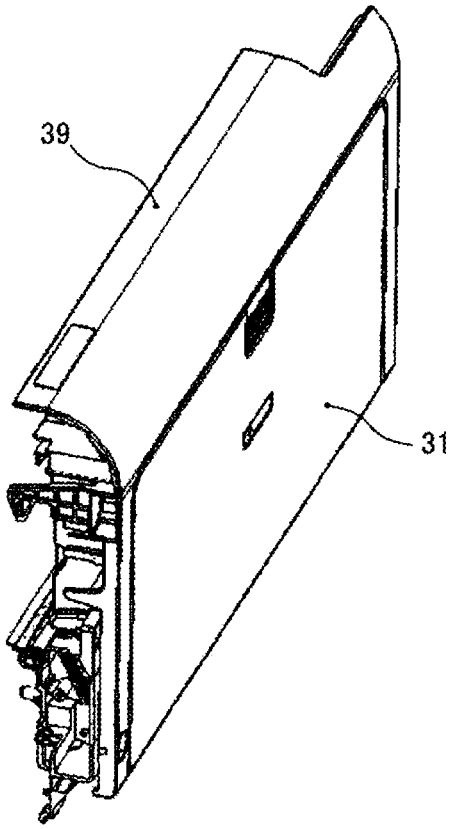
Figure 16A:
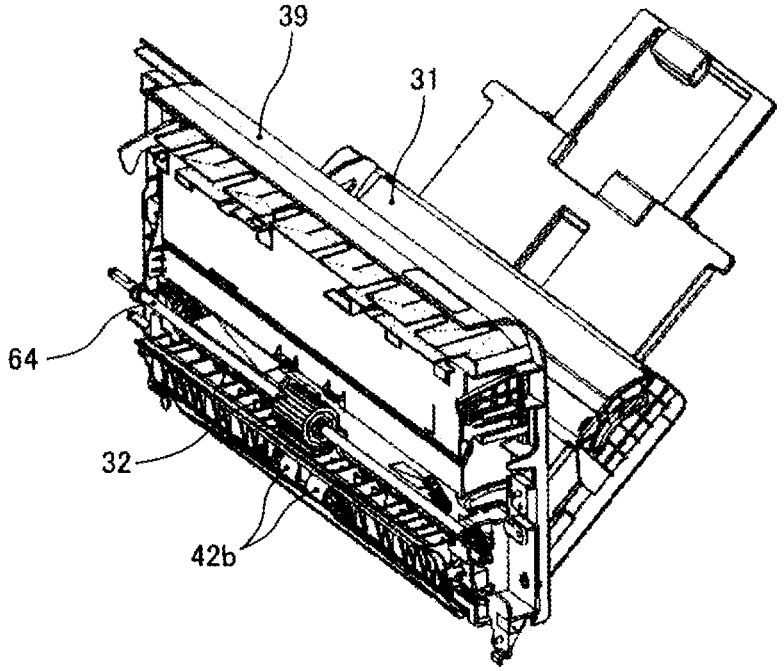
FIGS. 16A and 16B are perspective views each illustrating that the bypass tray is open in a state in which the door is closed to the housing of the image forming apparatus.
Figure 16B:
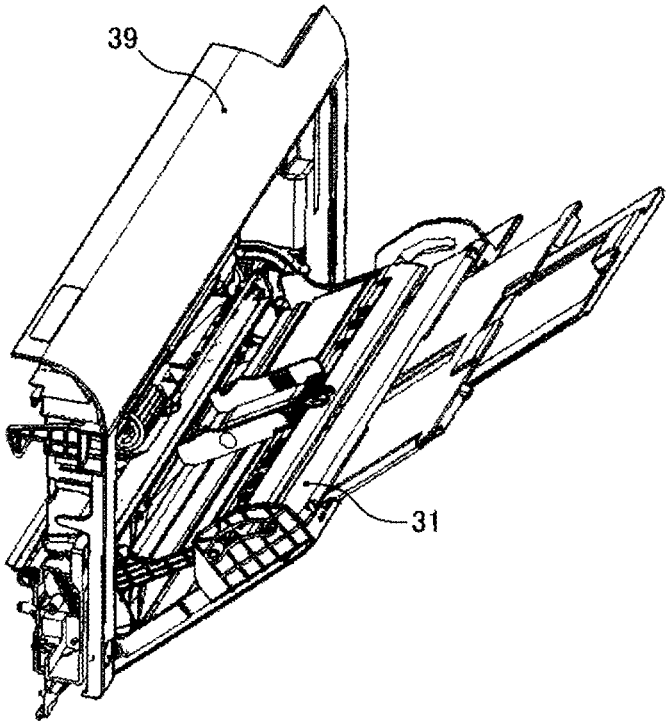

A further detailed description is given of the configuration of the relay drive roller 42*a* and the relay driven roller 42*b* of the pair of relay rollers 42. FIGS. 14A and 14B are perspective views each illustrating a door 39 to which the bypass sheet tray 31 is attached and the door 39 is open from the housing of the image forming apparatus 1000. FIGS. 15A and 15B are perspective views each illustrating the door 39 to which the bypass sheet tray 31 is attached and the door 39 is closed to the housing of the image forming apparatus 1000. FIGS. 16A and 16B are perspective views each illustrating that the bypass sheet tray 31 is open in a state in which the door 39 is closed to the housing of the image forming apparatus 1000.

As described above, the bypass sheet feeder 30 in the present embodiment has a unit structure in which the relay driven roller 42*b* of the pair of relay rollers 42 is supported integrally with the bypass sheet feeding mechanism. The unit structure including the relay driven roller 42*b* and the bypass sheet feeding mechanism is screwed and fixed to the main-body housing 50 of the image forming apparatus 1000. The door 39 is attached to open and close with respect to the bypass sheet feeding mechanism via a hinge mechanism. The bypass sheet tray 31 is attached to open and close with respect to the door 39 via the hinge mechanism. In the present embodiment, by opening the door 39, the process cartridge containing the photoconductor 1 is attached and detached with respect to the main-body housing 50 of the image forming apparatus 1000 and the recording sheet S that is jammed in the image forming apparatus 1000 is removed from the image forming apparatus 1000.

However, since the relay driven roller 42*b* is supported not by the door 39 but by the bypass sheet feeding mechanism that is screwed and fixed to the main-body housing 50 of the image forming apparatus 1000, the relay driven roller 42*b* and the relay drive roller 42*a* that is provided in the main-body housing 50 of the image forming apparatus 1000 are configured so as not to be separated from each other.

Here, when a device error (problem) to suspend conveyance of the recording sheet S, such as a paper jam error, occurs to the image forming apparatus 1000, the recording sheet S remaining in the image forming apparatus 1000 needs to be removed. Hereinafter, the device error is explained with an example of the device error caused by the paper jam. Specifically, in the present embodiment, the regular sheet tray 100 is removed from the image forming apparatus 1000 in the sheet conveyance direction or in a direction intersecting the sheet conveyance direction, so that the recording sheet S remaining in the image forming apparatus 1000 is removed (pulled out) from the regular sheet feeder 110. At this time, in order to restrain the recording sheet S, for example, a thin paper and a plain paper each having a relatively low strength, from being torn when the recording sheet S is pulled out, it is preferable to open (separate) the possible areas in which the recording sheet S is held (such as the sheet conveyance nip region of the pair of relay rollers 42 and the nip region of the bypass sheet feed roller 32 and the bypass bottom plate 34).

As the example of a configuration in which the rollers of the pair of relay rollers 42 are separated from each other, known image forming apparatuses employ a configuration in which the relay driven roller 42*b* is supported on the door openably and closably attached to the main-body housing 50 of the image forming apparatus 1000. With this configuration, the pair of relay rollers 42 may be separated by opening the door. However, as described above, since the relay drive roller 42*a* and the relay driven roller 42*b* of the pair of relay rollers 42 are configured so as not to be separated from each other, the pair of relay rollers 42 may not be opened (may not be separated from each other).

Therefore, in the present embodiment, in a case in which a paper jam occurs while the recording sheet S is conveyed in the regular sheet feeder 110, when the recording sheet S that is held by the pair of relay rollers 42 is removed (pulled out), the recording sheet S having a relatively high strength may be torn. In order to restrain this inconvenience, when conveying the recording sheet S having a relatively low strength (e.g., a thin paper and a plain paper), the nip pressure (contact pressure) of the pair of relay rollers 42 is changed to the low nip pressure. Accordingly, even though a paper jam occurs while the recording sheet S such as a thin paper or a plain paper is conveyed, since the nip pressure of the pair of relay rollers 42 is relatively low, the recording sheet S is restrained from being torn when pulling out of the recording sheet S from the pair of relay rollers 42 in the state.

At this time, since the nip pressure of the pair of relay rollers 42 is relatively low, in a case in which the conveyance load of the recording sheet S (e.g., the sliding with the conveyance guide and the conveyance resistance when the leading end of the recording sheet S enters the pair of relay rollers 42) is relatively large, it is likely that the recording sheet S slips at the sheet conveyance nip region of the pair of relay rollers 42, which may cause a conveyance failure in which the recording sheet S is not conveyed properly. However, the recording sheet S such as a thin paper or a plain paper is relatively thin and generally has a low rigidity. Therefore, even when the conveyance load is relatively small and the nip pressure of the pair of relay rollers 42 is relatively low, the conveyance failure is not likely to occur. Therefore, as long as the recording sheet S is a thin paper or a plain paper, even when the nip pressure of the pair of relay rollers 42 is relatively low, the stable sheet conveyance is performed.

On the other hand, when the recording sheet S having a relatively high strength (e.g., thick paper) that is hard to tear is conveyed, the high nip pressure is selected as the nip pressure (contact pressure) of the pair of relay rollers 42. In a case in which the recording sheet S is a thick paper, if the nip pressure of the pair of relay rollers 42 is relatively low, the conveyance failure is likely to occur. However, in the present embodiment, the pair of relay rollers 42 has the high nip pressure when conveying the recording sheet S (thick paper). Therefore, the conveyance failure is hard to occur, thereby achieving the stable sheet conveyance. Further, even if a paper jam occurs, as long as the recording sheet S is a thick paper, even when the nip pressure of the pair of relay rollers 42 is in the high nip pressure state, it is not likely to tear the recording sheet S when the recording sheet S is pulled out from the pair of relay rollers 42.

Note that, if a known configuration is employed to reduce the nip pressure (contact pressure) of the pair of relay rollers 42 after a paper jam has occurred, as long as the operation is performed appropriately after the occurrence of the paper jam, the known configuration may restrain the recording sheet S having a relatively low strength from being torn when the recording sheet S is pulled out. However, depending on the timing of occurrence of the paper jam or the configuration to achieve the paper jam handling, it is not likely to reduce the nip pressure of the pair of relay rollers 42 after the paper jam has occurred. For example, when the above-described jam detection sensor (e.g., the registration sensor 49) is erroneously detected or malfunctions, or the image forming apparatus is immediately disconnected, the drive sources of the main motor 61 and the clutches 62*a*, 63*a*, 64*a*, and 65*a* may not be driven normally, and therefore the nip pressure of the pair of relay rollers 42 may not be lowered when pulling out the jammed recording sheet S.

By contrast, in the present embodiment, in a case in which the recording sheet S is a thin paper or a plain paper, the biasing force of pressure spring 37*b* that biases the relay driven roller 42*b* toward the relay drive roller 42*a* is reduced to lower the nip pressure of the pair of relay rollers 42 before the paper jam occurs, to be more specific, before the recording sheet S is held by the pair of relay rollers 42. Therefore, since there is no need to perform the operation to lower the nip pressure of the pair of relay rollers 42 after occurrence of the paper jam, the recording sheet S such as a thin paper or a plain paper is pulled out while the nip pressure of the pair of relay rollers 42 is relatively low when the paper jam has occurred.

Next, a description is given of change the nip pressure of the pair of relay rollers 42. In the present embodiment, the nip pressure of the pair of relay rollers 42 is changed in the regular sheet conveyance passage R1 along with movement of a movable member that is used for conveying the recording sheet S in the bypass sheet conveyance passage R2. In the present embodiment, when the recording sheet S is conveyed using the regular sheet conveyance passage R1, the bypass sheet conveyance passage R2 is not used to convey the recording sheet S. Accordingly, when the recording sheet S is conveyed in the regular sheet conveyance passage R1, even if the movable member that is used to convey the recording sheet S in the bypass sheet conveyance passage R2 is moved, no problem occurs.

In the present embodiment, a sheet feeder for bypass sheet feeding such as the bypass sheet feeder 30 causes the recording sheet S on the bypass bottom plate 34 to contact (press against) the bypass sheet feed roller 32, thereby feeding the recording sheet S. Therefore, in the present embodiment, the bypass bottom plate 34 functions as a movable member. Along with movement of the bypass bottom plate 34, the nip pressure of the pair of relay rollers 42 is changed.

Specifically, the moving unit that causes the bypass bottom plate 34 to move rotates the bypass bottom plate cam shaft 65 by the driving force of the main motor 61, as described above. Then, when the bypass bottom plate cam shaft 65 is located at a rotational position at which the bypass bottom plate cam 35 presses down the bottom plate guide 34*a* against the biasing force of the bottom plate spring 36, the bypass bottom plate 34 is lowered (moved downward) to separate from the bypass sheet feed roller 32 (see FIGS. 13 and 18A). On the other hand, when the bypass bottom plate cam shaft 65 is located at the rotational position at which the bypass bottom plate cam 35 separates from the bottom plate guide 34*a*, the bypass bottom plate 34 is lifted (moved upward) by the biasing force of the bottom plate spring 36 to contact the bypass sheet feed roller 32 (see FIGS. 11 and 18B).

The sheet conveying device 200 further includes a pressure plate 37*d* that functions as a biasing force changer according to the present embodiment. The pressure plate 37*d* also functions as a biasing support that supports pressure spring 37*b* that biases the bearing 37*a* of the relay driven roller 42*b* toward the relay drive roller 42*a*. As the pressure plate 37*d* is rotated along with rotation of the bypass bottom plate cam shaft 65, the biasing force of pressure spring 37*b* is changed to change the nip pressure of the pair of relay rollers 42. Note that a slider is fastened to the pressure plate 37*d* and *s* configured to move along a guide portion provided in the support frame 38 of the bypass sheet feeder 30. Thus, the slider is configured to move linearly along a direction in which the slider moves toward and away from the relay drive roller 42*a*.

Figure 17:
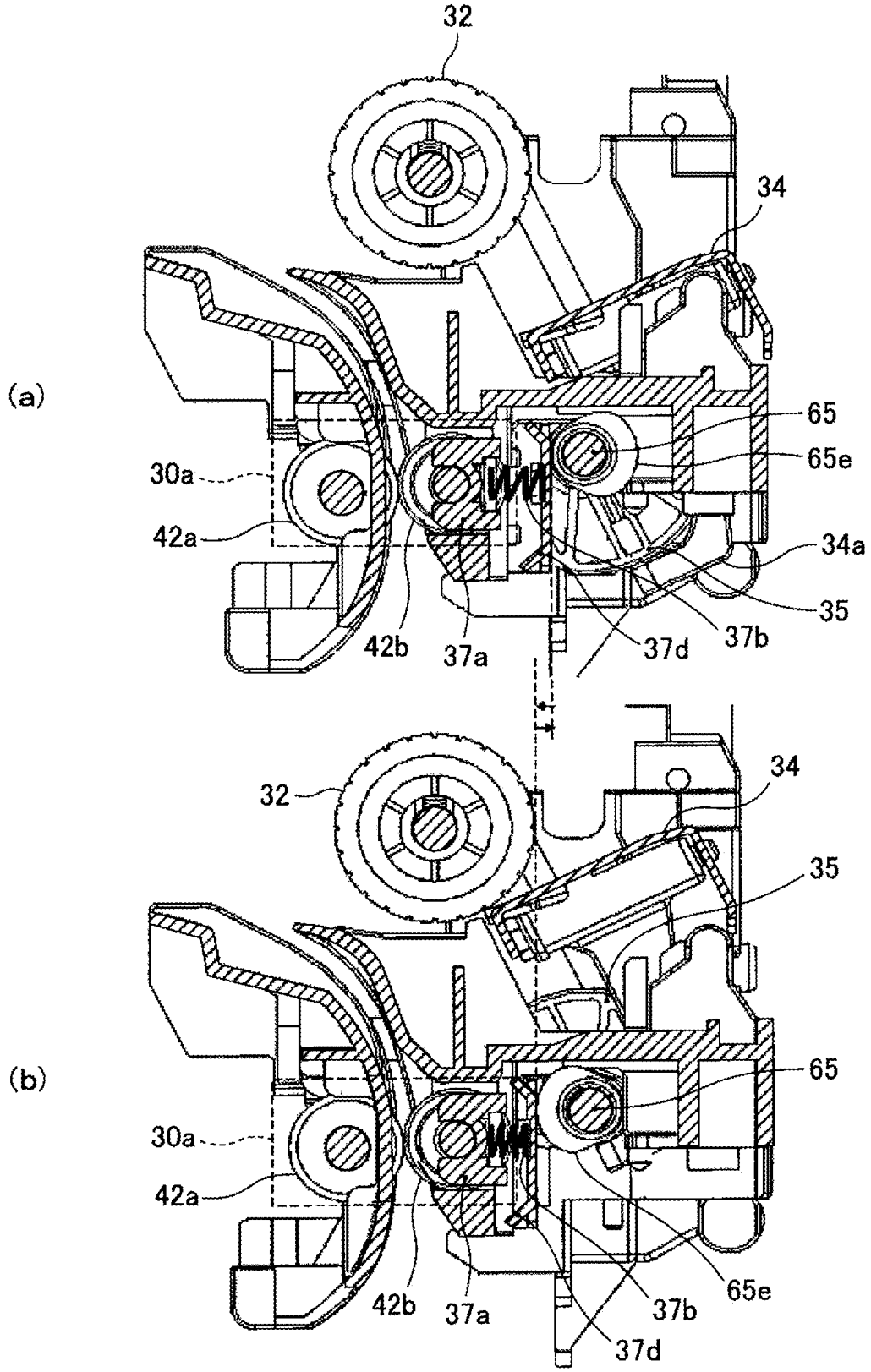
FIG. 17 is a diagram illustrating a biasing force changer that changes the biasing force of the pressure spring that presses the bearing of the relay driven roller toward the relay drive roller.
Figure 18B:
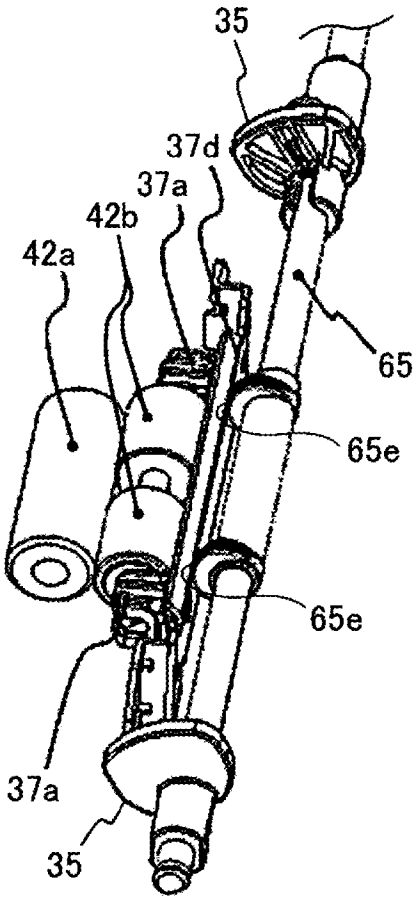
FIGS. 18A and 18B are perspective views each illustrating the main configuration of the biasing force changer.
Figure 18A:
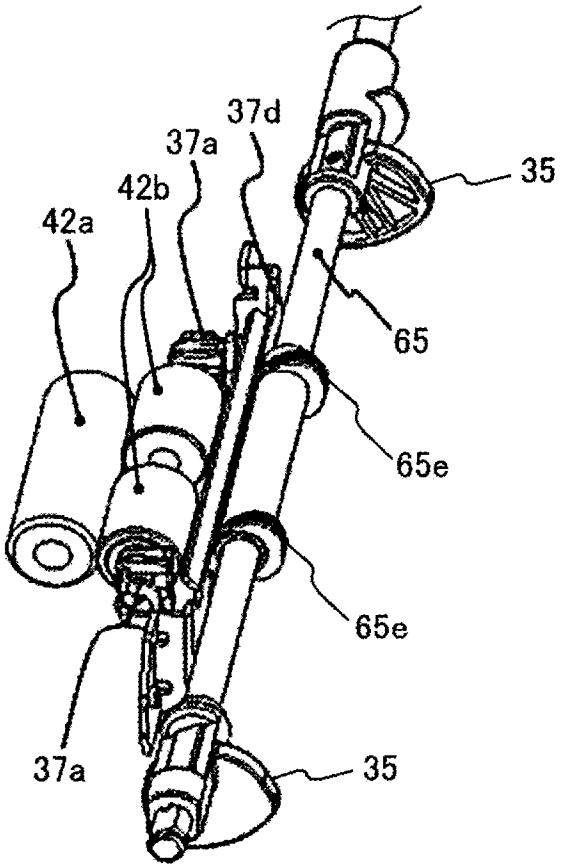
Figure 19A:
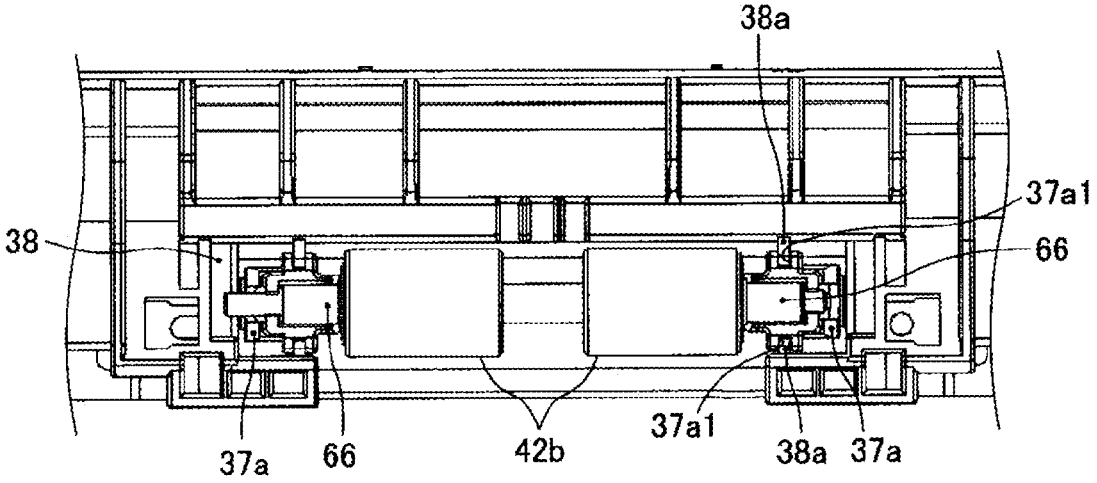
FIG. 19A is a diagram illustrating a mechanism that supports the relay driven roller.
Figure 19B:
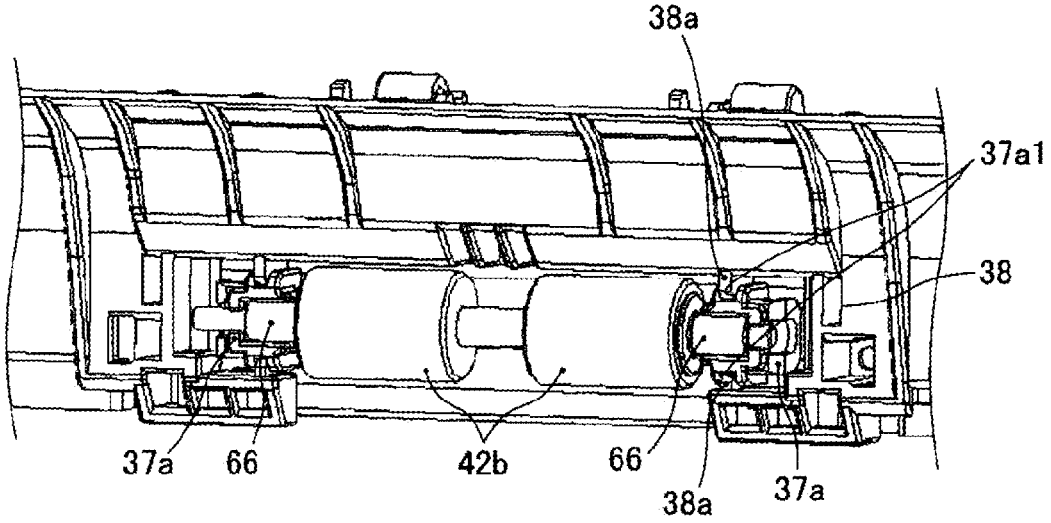
FIG. 19B is a perspective view of the mechanism of FIG. 19A.

FIG. 17 is a diagram illustrating, in the present embodiment, the biasing force changer that changes the biasing force of the pressure spring 37*b* that presses the bearing 37*a* of the relay driven roller 42*b* toward the relay drive roller 42*a*. FIGS. 18A and 18B are perspective views each illustrating the main configuration of the biasing force changer. FIGS. 19A and 19B are diagrams illustrating a mechanism that supports the relay driven roller 42*b*.

As illustrated in FIGS. 19A and 19B, a guide groove 37*a*1 that is provided on the bearing 37*a* of the relay driven roller 42*b* is fitted to a projection 38*a* that is provided on the support frame 38 of the bypass sheet feeder 30. By so doing, the roller shaft 66 of the relay driven roller 42*b* is held so that the relay driven roller 42*b* slides in a direction to separate from the relay drive roller 42*a*. Further, as described above, the bearing 37*a* of the relay driven roller 42*b* is biased by the pressure spring 37*b*, toward the relay drive roller 42*a*.

The pressure spring 37*b* is a compression spring disposed so that one end of the pressure spring 37*b* contacts the bearing 37*a* of the relay driven roller 42*b* and the opposite end of the pressure spring 37*b* contacts the pressure plate 37*d*. The bearing 37*a* of the relay driven roller 42*b* is biased toward the relay drive roller 42*a* by the biasing force of the pressure spring 37*b* supported by the pressure plate 37*d*. The pressing portion 65*e* that is capable of pressing the pressure plate 37*d* toward the relay drive roller 42*a* is formed on the back face of the pressure plate 37*d*, which is opposite a spring contact face to which the pressure spring 37*b* contacts. The pressing portion 65*e* rotates along with rotation of the bypass bottom plate cam shaft 65.

When the rotational position of the bypass bottom plate cam shaft 65 is located at a position to lower the bypass bottom plate 34 (that is, a position at which the bypass bottom plate 34 separates from the bypass sheet feed roller 32), the pressing portion 65*e* on the bypass bottom plate cam shaft 65 is located at a non-pressing position, as illustrated in part (a) of FIG. 17 and FIG. 18A. At this time, the pressure plate 37*d* moves in the direction to separate from the relay drive roller 42*a* by the biasing force of the pressure spring 37*b*. Therefore, the pressure spring 37*b* expands to decrease the amount of contraction, thereby reducing the biasing force of the pressure spring 37*b*. Thus, the biasing force to bias the relay driven roller 42*b* toward the relay drive roller 42*a* is reduced, and the nip pressure of the pair of relay rollers 42 is lowered. Note that, since the bypass bottom plate 34 remains separated from the bypass sheet feed roller 32, the recording sheet S is not fed from the bypass sheet feeder 30. However, conveyance of the recording sheet S in the regular sheet feeder 110 does not hinder conveyance of the recording sheet S from the bypass sheet feeder 30.

By contrast, when the rotational position of the bypass bottom plate cam shaft 65 is located at a position to lift the bypass bottom plate 34 (that is, a position at which the bypass bottom plate 34 contacts the bypass sheet feed roller 32), the pressing portion 65*e* on the bypass bottom plate cam shaft 65 is located at a pressing position, as illustrated in part (b) of FIG. 17 and FIG. 18B. At this time, the pressure plate 37*d* moves in the direction to approach the relay drive roller 42*a* against the biasing force of the pressure spring 37*b*. Therefore, the pressure spring 37*b* contracts to increase the amount of contraction, thereby increasing the biasing force of the pressure spring 37*b*. As a result, the biasing force to bias the relay driven roller 42*b* toward the relay drive roller 42*a* increases, the nip pressure of the pair of relay rollers 42 increases. Note that, since the bypass bottom plate 34 remains in contact with the bypass sheet feed roller 32, the recording sheet S is not fed from the bypass sheet feeder 30. However, conveyance of the recording sheet S in the regular sheet feeder 110 does not hinder conveyance of the recording sheet S from the bypass sheet feeder 30.

According to the present embodiment, the nip pressure of the pair of relay rollers 42 (the biasing force of pressure spring 37*b*) is changed in the regular sheet conveyance passage R1 along with movement of the bypass bottom plate 34 that functions as a movable member used for conveying the recording sheet S in the bypass sheet conveyance passage R2. Accordingly, a simple configuration that does not include a dedicated operation unit that changes the nip pressure of the pair of relay rollers 42 achieves the change in the nip pressure of the pair of relay rollers 42.

Figure 20:
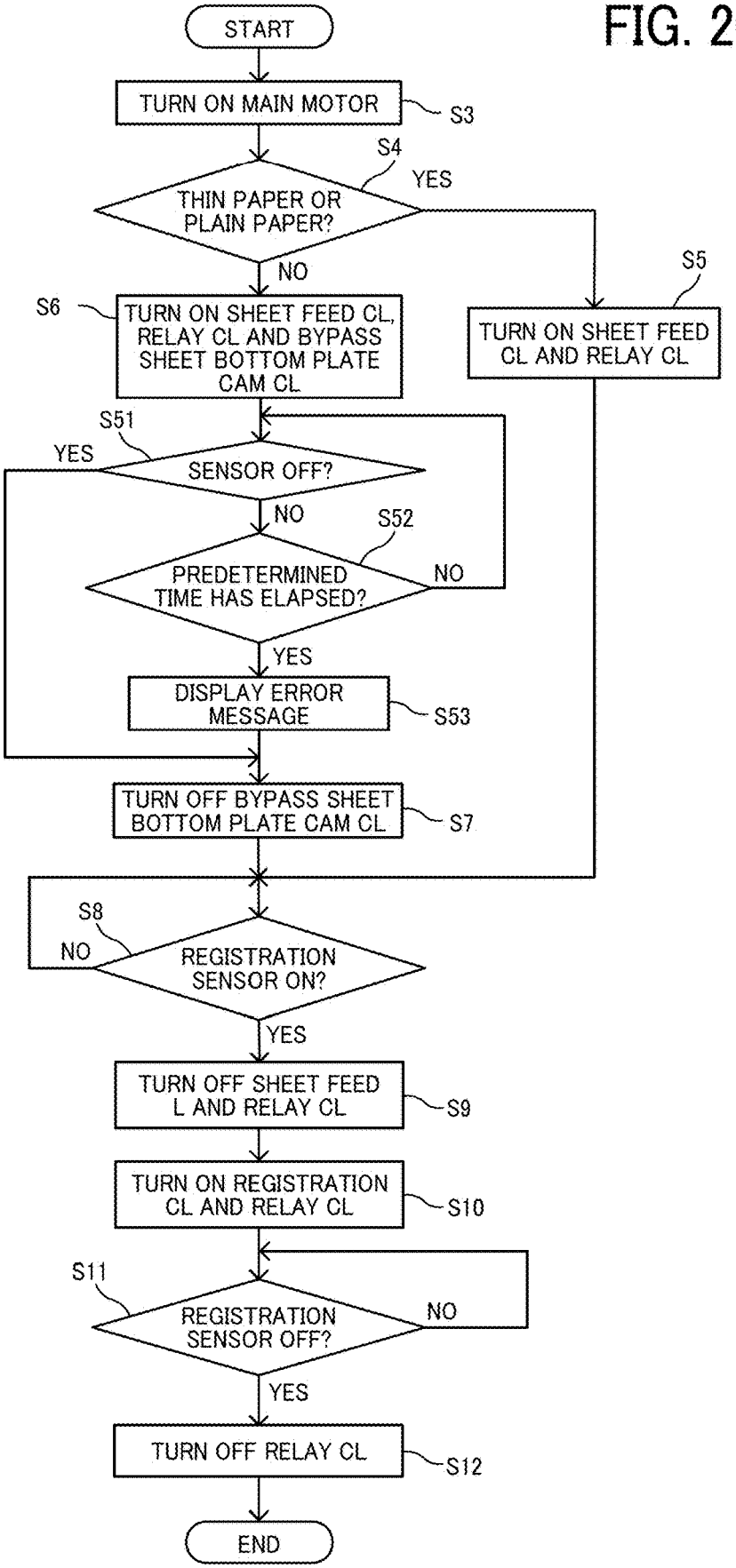
FIG. 20 is a flowchart of a control operation of sheet conveyance from a regular sheet feeder according to a variation.

Next, a variation of the control operation in feeding and conveying in the present embodiment is described. FIG. 20 is a flowchart of a control operation of sheet conveyance from the regular sheet feeder in the present variation. In the present variation, the initial operation is not performed. Instead, the bypass bottom plate cam clutch 65*a* is turned off based on the output of the feeler sensor 65*c*. The controller 51 determines that there is an abnormality when the output state of the feeler sensor 65*c* does not change within a predetermined time.

In the present variation, when the controller 51 turns on the main motor 61 (step S3), the controller 51 determines whether the recording sheet S to be fed is a thin paper or a plain paper (step S4). By contrast, when the controller 51 has determined the recording sheet S is not a thin paper or a plain paper, in other words, when the controller 51 has determined the recording sheet S is a thick paper (NO in step S4), the controller 51 performs a process operation to increase the nip pressure of the pair of relay rollers 42. For example, the controller 51 turns on the regular sheet feed clutch 62*a* and the relay clutch 63*a* (step S6), and also turns on the bypass bottom plate cam clutch 65*a* at that timing (step S6). Thus, the bypass bottom plate cam shaft 65 is driven to rotate.

When the feeler sensor 65*c* is turned off (YES in S51), the bypass bottom plate cam clutch 65*a* is turned off (step S7) to stop the rotation of the bypass bottom plate cam shaft 65. Thus, the nip pressure of the rollers of the pair of relay rollers 42 is changed to a high state.

In the present variation, the bearing 37*a* that bears the roller shaft 66 is also biased by the pressure spring 37*b* with a low biasing force in the case of thin paper or plain paper and with a high biasing force in the case of thick paper. The recording sheet S is conveyed in a state in which the recording sheet S is sandwiched (held) in the nip region of the pair of relay rollers 42. Then, when the leading end of the recording sheet S reaches the registration sensor 49, the controller 51 determines whether the registration sensor 49 has turned on (step S8). When the registration sensor 49 has turned on (YES in step S8), the controller 51 turns off the regular sheet feed clutch 62*a* and the relay clutch 63*a* after a given time has elapsed (step S9). After step S9, conveyance of the recording sheet S is temporarily stopped. Then, the controller 51 turns on the relay clutch 63*a* and the registration clutch at a timing at which the recording sheet S is overlaid on the toner image formed on the surface of the photoconductor 1 in the transfer nip region (step S10). Then, the controller 51 determines whether the registration sensor 49 is turned off (step S11). When the trailing end of the recording sheet S reaches the registration sensor 49 and the registration sensor 49 is turned off (YES in step S11), the controller 51 turns off the relay clutch 63*a* (step S12) to stop rotation of the pair of relay rollers 42.

On the other hand, when the predetermined time has elapsed without the feeler sensor 65*c* being turned off (NO in S51 and YES in S52), the controller 51 displays a failure message on the operation panel of the image forming apparatus 1000 (step S53) and executes processing of notifying an abnormality in the changing operation of the nip pressure of the pair of relay rollers 42. Thereafter, the controller 51 turns off the bypass bottom plate cam clutch 65*a* (S7) while the sheet conveyance is continued. Then, the controller 51 continues the sheet conveying operation as it is (S8 to S12).

As described above, in the configuration of the present embodiment, the nip pressure of the pair of relay rollers 42 (e.g., the biasing force of pressure spring 37*b*) that is used for conveying the recording sheet S in the regular sheet conveyance passage R1 is changed along with movement of the bypass bottom plate 34 functioning as a movable member that is used for conveying the recording sheet S in the bypass sheet conveyance passage R2. However, a configuration of the sheet conveying device is not limited to this configuration. For example, in a case in which the bypass sheet feeder 30 employs a sheet feeder having a configuration in which the bypass sheet feed roller 32 is lowered (moved downward) to press (contact) the bypass sheet feed roller 32 to a recording sheet on the bypass sheet tray 31 to feed the recording sheet, the bypass sheet feed roller 32 may be a movable member to change the nip pressure of the pair of relay rollers 42 along with movement of the bypass sheet feed roller 32. Further, for example, the rollers of the pair of relay rollers 42 may be changed along with movement of a movable member that is used in a sheet conveyance passage other than the bypass sheet conveyance passage R2 (for example, the reverse sheet conveyance passage R5).

Further, in the present embodiment, a description of the changing unit to change the nip pressure of the pair of relay rollers 42 (the biasing force of pressure spring 37*b*) used in the regular sheet conveyance passage R1 has been made but any other changing unit may be applied. For example, a changing unit to change the nip pressure of another pair of conveyance rollers (for example, the pair of sheet ejection rollers 46) may be employed. In addition, the pair of relay rollers 42 of the present embodiment is a target object to change the nip pressure is a pair of sheet conveying rollers including a drive roller and a driven roller.

However, the configuration of the pair of sheet conveying rollers applied to the present embodiment is not limited to the above-described pair of relay rollers 42. For example, the pair of sheet conveying rollers may include two drive rollers or two driven rollers.

Further, in the present embodiment according to this disclosure, the image forming apparatus 1000 is described as an example of a printer. However, the image forming apparatus 1000 may be a copier including an image reading device or a copier having a function of a facsimile machine. Further, this disclosure is applicable to image forming apparatuses adapted to form images through other schemes, such as known ink jet schemes, known toner projection schemes, or the like as well as to image forming apparatuses adapted to form images through electrophotographic schemes. Further, as long as a sheet conveying device is provided, this disclosure is not limited to an image forming apparatus but is also applicable to an image reading device provided with an automatic document feeder (ADF).

The above-described embodiments are only examples and, for example, in the following aspects of the present disclosure, advantages described below can be obtained.

Aspect 1

According to Aspect 1, a sheet conveying device (for example, the sheet conveying device 200) includes a pair of rollers (for example, the pair of relay rollers 42), a biasing member (for example, the pressure spring 37*b*), a biasing force changer (for example, the pressure plate 37*d* and the pressing portion 65*e*), a controller (for example, the controller 51) serving as control circuitry, an operation detector (for example, the cam detection feeler 65*b* and the feeler sensor 65*c*), and a notification device (for example, the controller 51 and the operation panel). The pair of rollers includes a first roller (for example, the relay driven roller 42*b*) and a second roller (for example, the relay drive roller 42*a*). The pair of rollers is configured to hold a sheet (for example, the recording sheet S) between the first roller and the second roller while the sheet is conveyed. The biasing member is configured to bias the first roller toward the second roller. The biasing force changer is configured to change a biasing force of the biasing member. The control circuitry is configured to, when a predetermined changing condition is met (for example, the type of the sheet is thick paper), cause the biasing force changer to change the biasing force and cause the pair of rollers to convey the sheet. The operation detector is configured to detect the changing operation of the biasing force changer. The notification device is configured to notify an abnormality when the operation detector detects the abnormality of the changing operation. The control circuitry is configured to, when the operation detector detects an abnormality of the changing operation, perform sheet conveyance control to cause the pair of rollers to convey the sheet without causing the biasing force changer to change the biasing force, regardless of whether the predetermined changing condition is met. In the present aspect, when the predetermined changing condition is met, the sheet can be conveyed by the pair of rollers after the biasing force changer changes the biasing force. With such a configuration, for example, when a thick sheet is conveyed, the biasing force is changed to a large biasing force to increase the nip pressure of the pair of rollers. When a thin sheet is conveyed, the biasing force is changed to a small biasing force to decrease the nip pressure of the pair of rollers. Such control contributes to both realization of stable conveyance of a thick sheet and realization of facilitation of a jam removal operation by making the sheet less likely to break when a thin sheet held (nipped) by the pair of rollers is pulled out at the time of a jam. In a conventional sheet conveying apparatus, when an abnormality of a changing operation for changing a nip pressure (biasing force) of a pair of rollers is detected, the abnormality is generally notified to a user or the like, and a sheet cannot be conveyed by the pair of rollers until the abnormality is eliminated, thus resulting in downtime. However, as described above, in the configuration in which the biasing force is changed by the biasing force changer and the sheet is conveyed by the pair of rollers, the sheet conveyance is not completely impossible even in a situation in which the changing operation of the biasing force is not successfully performed (in a case in which an abnormality is detected). For example, even if the sheet conveyance is continued in a situation in which the changing operation of the biasing force is not performed, the sheet conveyance can be performed without causing a problem in a short period of time, depending on the way of determining the setting values of various sheet conveyance conditions such as the setting value of the biasing force to be changed and the setting value of the sheet conveyance speed. Hence, in the present aspect, when the operation detector detects the abnormality of the changing operation, the notification device notifies the abnormality, and the sheet conveyance by the pair of rollers is executed regardless of whether the predetermined changing condition is met. Such a configuration allows the sheet conveyance to be continued until a process of eliminating the abnormality of the changing operation due to the notification of the abnormality is performed, thus restraining the occurrence of downtime.

Aspect 2

According to Aspect 2, in Aspect 1, the control circuitry determines whether the predetermined changing condition is met according to the type of the sheet. Such a configuration allows the sheet to be conveyed by an appropriate biasing force corresponding to the type of the sheet.

Aspect 3

According to Aspect 3, in Aspect 2, the type of the sheet includes a type relating to different thicknesses of sheets. Such a configuration allows the sheet to be conveyed by an appropriate biasing force corresponding to the thickness of the sheet.

Aspect 4

According to Aspect 4, in Aspect 3, the biasing force changer changes the biasing force so that the biasing force increases as the thickness of the sheet increases. Such a configuration allows the sheet to be conveyed by an appropriate biasing force corresponding to the thickness of the sheet.

Aspect 5

According to Aspect 5, in any one of Aspects 1 to 4, the notification device notifies the abnormality visually or auditorily. Such a configuration can appropriately notify the abnormality.

Aspect 6

According to Aspect 6, in any one of Aspects 1 to 5, the control circuitry performs the sheet conveyance control when the operation detector detects an abnormality of the changing operation when the biasing force changer changes the biasing force to perform sheet conveyance by the pair of rollers. According to this configuration, as in the variation described above, even when the operation detector detects an abnormality in the changing operation when the biasing force changer changes the biasing force to perform sheet conveyance by the pair of rollers, the sheet conveyance can be continued, thus restraining the occurrence of downtime.

Aspect 7

According to Aspect 7, in any one of Aspects 1 to 6, the control circuitry performs a confirmation operation (for example, the initial operation) of confirming whether the operation detector detects the abnormality of the changing operation before the pair of rollers performs sheet conveyance, and performs the sheet conveyance control when the operation detector detects the abnormality of the changing operation in the confirmation operation. According to this configuration, as in the above-described variation, even when the operation detector detects an abnormality of the changing operation in the confirmation operation, the sheet conveyance can be continued, thus restraining the occurrence of downtime.

Aspect 8

According to an Aspect 8, in any one of Aspects 1 to 7, the control circuitry changes the biasing force based on an operation start timing of a sheet feeding member (for example, the regular sheet feed roller 41) that conveys the sheet on an upstream side of the pair of rollers in a sheet conveyance direction. According to this configuration, even when there is no sheet detector that detects the sheet being conveyed on the upstream side of the pair of rollers in the sheet conveyance direction, the changing operation can be appropriately completed before the leading edge of the sheet reaches the pair of rollers.

Aspect 9

According to Aspect 9, in any one of Aspects 1 to 7, the control circuitry changes the biasing force based on a detection timing of a sheet detector (for example, the conveyance sensors 45A and 45B) that detects the sheet being conveyed on an upstream side of the pair of rollers in the sheet conveyance direction. According to this configuration, the changing operation can be appropriately completed before the leading edge of the sheet reaches the pair of rollers.

Aspect 10

According to Aspect 10, an image forming apparatus (for example, the image forming apparatus 1000) includes the sheet conveying device (for example, the sheet conveying device 200) according to any one of Aspects 1 to 9, and an image forming device (for example, the photoconductor 1) configured to form an image on the sheet (for example, the recording sheet S) conveyed by the sheet conveying device. According to the present aspect, there can be provided an image forming apparatus capable of restraining the occurrence of downtime even when an abnormality in the changing operation of changing the nip pressure (biasing force) of the pair of rollers is detected.

Aspect 11

According to Aspect 11, in Aspect 10, the image forming apparatus includes a plurality of sheet conveyance passages (e.g., the regular sheet conveyance passage R1 and the bypass sheet conveyance passage R2) and a movable member (e.g., bypass bottom plate 34). The pair of rollers of the sheet conveying device hold a sheet conveyed through a first sheet conveyance passage (e.g., the regular sheet conveyance passage R1) among the plurality of sheet conveyance passage. The biasing force changer changes the biasing force of the biasing member in conjunction with an operation of the movable member that operates when the sheet is conveyed through a second sheet conveyance passage (e.g., the bypass sheet conveyance passage R2) among the plurality of sheet conveyance passages. In the present aspect, the operation of changing the contact pressure of the pair of rollers (in other words, the biasing force by the biasing member) in the first sheet conveyance passage is performed in conjunction with the operation of the movable member used for sheet conveyance in the second sheet conveyance passage. In the image forming apparatus according to the present aspect, when the sheet is conveyed using the sheet conveyance passage selected from the plurality of sheet conveyance passages, the other sheet conveyance passage is not used for sheet conveyance. Accordingly, even if the movable member used for sheet conveyance in the second sheet conveyance passage is operated when the contact pressure of the pair of rollers in the first sheet conveyance passage is changed, no problem occurs. According to the present aspect, the contact pressure of the pair of rollers of the first sheet conveyance passage can be changed by the operation of the movable member used for sheet conveyance in the second sheet conveyance passage. Therefore, an operation unit dedicated to the changing of the contact pressure can be obviated, thus achieving downsizing and cost reduction of the image forming apparatus.

Aspect 12

According to Aspect 12, in any one of Aspect 11, the second sheet conveyance passage is a bypass sheet conveyance passage (for example, the bypass sheet conveyance passage R2) for manual feeding. According to this configuration, the operation of the movable member of the bypass sheet conveyance passage can be used to change the contact pressure of the pair of rollers in a main-body housing of the image forming apparatus.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

The invention claimed is:

1. A sheet conveying device, comprising:

a pair of rollers including a first roller and a second roller configured to hold a sheet conveyed between the first roller and the second roller;

a biasing member configured to bias the first roller toward the second roller;

a biasing force changer configured to change a biasing force of the biasing member between at least a first biasing force and a second biasing force;

control circuitry configured to, in response to a desired changing condition being met, cause the biasing force changer to change the biasing force and cause the pair of rollers to convey the sheet;

an operation detector configured to detect whether a changing operation of changing the biasing force of the biasing force changer between at least the first biasing force and the second biasing force has been performed, and detect an abnormality of the changing operation in response to the changing operation not being performed; and the control circuitry being further configured to, in response to the operation detector detecting the abnormality of the changing operation has occurred, perform sheet conveyance control to cause the pair of rollers to convey the sheet without causing the biasing force changer to change the biasing force, regardless of whether the desired changing condition is met.

2. The sheet conveying device according to claim 1, wherein the control circuitry is further configured to determine whether the desired changing condition is met according to a type of the sheet.

3. The sheet conveying device according to claim 2, wherein the type of the sheet includes a type relating to different thicknesses of sheets.

4. The sheet conveying device according to claim 3, wherein the biasing force changer is configured to change the biasing force so that the biasing force increases as a thickness of the sheet increases.

5. The sheet conveying device according to claim 1, wherein the control circuitry is further configured to:

perform the sheet conveyance control in response to the operation detector detecting the abnormality of the changing operation has occurred in response to the biasing force being changed by the biasing force changer to perform sheet conveyance by the pair of rollers.

6. The sheet conveying device according to claim 1, wherein the control circuitry is further configured to:

perform a confirmation operation of confirming whether the operation detector detects the abnormality of the changing operation has occurred before the pair of rollers convey the sheet; and perform the sheet conveyance control in response to the operation detector detecting the abnormality of the changing operation has occurred in the confirmation operation.

7. The sheet conveying device according to claim 1, further comprising:

a sheet feeding member upstream from the pair of rollers in a direction of conveyance of the sheet, the sheet feeding member being configured to convey the sheet; and the control circuitry is further configured to change the biasing force based on an operation start timing of the sheet feeding member to convey the sheet.

8. The sheet conveying device according to claim 1, further comprising a sheet detector upstream from the pair of rollers in a direction of conveyance of the sheet; and the control circuitry is further configured to change the biasing force based on a detection timing at which the sheet detector detects the sheet being conveyed.

9. The sheet conveying device according to claim 1, further comprising:

a pressing portion configured to press the biasing member toward the second roller, the pressing portion being rotatable;

a sensor configured to change an output signal in accordance with the rotation of the pressing portion; and the operation detector is further configured to detect an abnormality of the changing operation has occurred in response to the output signal of the sensor not changing within a desired period of time after the control circuitry causes the pressing portion to rotate.

10. An image forming apparatus, comprising:

a sheet conveying device comprising, a pair of rollers including a first roller and a second roller configured to hold a sheet conveyed between the first roller and the second roller, a biasing member configured to bias the first roller toward the second roller, a biasing force changer configured to change a biasing force of the biasing member between at least a first biasing force and second biasing force, control circuitry configured to, in response to a desired changing condition being met, cause the biasing force changer to change the biasing force and cause the pair of rollers to convey the sheet, an operation detector configured to detect whether a changing operation of changing the biasing force of the biasing force changer between at least the first basing force and the second biasing force has been performed, and detect an abnormality of the changing operation has occurred in response to the changing operation not being performed, and the control circuitry being further configured to, in response to the operation detector detecting the abnormality of the changing operation has occurred, perform sheet conveyance control to cause the pair of rollers to convey the sheet without causing the biasing force changer to change the biasing force, regardless of whether the desired changing condition is met; and an image forming device configured to form an image on the sheet conveyed by the sheet conveying device.

11. The image forming apparatus according to claim 10, further comprising:

a plurality of sheet conveyance passages including a first sheet conveyance passage and a second sheet conveyance passage; and a movable member, wherein the pair of rollers of the sheet conveying device are configured to hold a sheet conveyed through the first sheet conveyance passage, and wherein the biasing force changer is further configured to change the biasing force of the biasing member in conjunction with an operation of the movable member that operates in response to the sheet being conveyed through the second sheet conveyance passage.

12. The image forming apparatus according to claim 11, wherein the second sheet conveyance passage is a bypass sheet conveyance passage configured for manual feeding.

13. A sheet conveying device, comprising:

a pair of rollers including a first roller and a second roller configured to hold a sheet conveyed between the first roller and the second roller;

a biasing member configured to bias the first roller toward the second roller;

a biasing force changer configured to change a biasing force of the biasing member between at least a first biasing force and a second biasing force;

control circuitry configured to, in response to a desired changing condition being met, cause the biasing force changer to change the biasing force and cause the pair of rollers to convey the sheet;

an operation detector configured to detect whether a changing operation of changing the biasing force of the biasing force changer between at least the first biasing force and the second biasing force has been performed, and detect an abnormality of the changing operation has occurred in response to the changing operation not being performed; and the control circuitry being further configured to, in response to the operation detector detecting the abnormality of the changing operation has occurred, perform sheet conveyance control to cause the pair of rollers to convey the sheet without causing the biasing force changer to change the biasing force, regardless of whether the desired changing condition is met, wherein the biasing force changer is further configured to change the biasing force so that the biasing force increases as a thickness of the sheet increases.

14. The sheet conveying device according to claim 13, further comprising:

a pressing portion configured to press the biasing member toward the second roller, the pressing portion being rotatable;

a sensor configured to change an output signal in accordance with the rotation of the pressing portion; and the operation detector is further configured to detect the abnormality of the changing operation has occurred in response to the output signal of the sensor not changing within a desired period of time after the control circuitry causes the pressing portion to rotate.

15. The sheet conveying device according to claim 13, wherein the control circuitry is further configured to determine whether the desired changing condition is met according to a type of the sheet.

16. The sheet conveying device according to claim 15, wherein the type of the sheet includes a type relating to different thicknesses of sheets.

17. The sheet conveying device according to claim 16, wherein the biasing force changer is configured to change the biasing force so that the biasing force increases as a thickness of the sheet increases.

18. The sheet conveying device according to claim 13, wherein the control circuitry is further configured to:

perform the sheet conveyance control in response to the operation detector detecting the abnormality of the changing operation has occurred in response to the biasing force being changed by the biasing force changer to perform sheet conveyance by the pair of rollers.

19. The sheet conveying device according to claim 13, wherein the control circuitry is further configured to:

perform a confirmation operation of confirming whether the operation detector detects the abnormality of the changing operation has occurred before the pair of rollers convey the sheet; and perform the sheet conveyance control in response to the operation detector detecting the abnormality of the changing operation has occurred in the confirmation operation.

20. The sheet conveying device according to claim 13, further comprising:

a sheet feeding member upstream from the pair of rollers in a direction of conveyance of the sheet, the sheet feeding member being configured to convey the sheet; and the control circuitry is further configured to change the biasing force based on an operation start timing of the sheet feeding member to convey the sheet.

* * * * *